United States Patent [19]

Yokoyama

[11] Patent Number: 5,009,281

[45] Date of Patent: Apr. 23, 1991

[54] ACOUSTIC APPARATUS

[75] Inventor: Kenji Yokoyama, Hamamatsu, Japan

[73] Assignee: Yamaha Corporation, Hamamatsu, Japan

[21] Appl. No.: 317,952

[22] Filed: Mar. 1, 1989

[30] Foreign Application Priority Data

Mar. 10, 1988 [JP] Japan ..... 63-56905
Mar. 10, 1988 [JP] Japan ..... 63-56906

[51] Int. Cl.[5] ..... H04R 7/00

[52] U.S. Cl. ..... 181/160; 181/153; 181/156; 281/96; 281/159

[58] Field of Search ..... 181/148, 150, 153, 156, 181/160, 163; 381/24, 89, 96, 159, 97, 100, 103, 106, 108, 120, 121, 153, 154, 158, 162

[56] References Cited

U.S. PATENT DOCUMENTS

| | | | |
|---|---|---|---|
| 3,037,081 | 5/1962 | Carlsson | 181/148 X |
| 3,812,473 | 6/1974 | Mullins | 381/96 |
| 3,984,635 | 10/1976 | Nestorovic et al. | 381/89 |
| 4,091,494 | 5/1978 | Micheron | 381/24 X |
| 4,180,706 | 12/1979 | Bakgaard | 381/96 |
| 4,549,631 | 10/1985 | Bose | 181/160 X |
| 4,741,040 | 4/1988 | Kaizer | 381/103 |

FOREIGN PATENT DOCUMENTS

| | | | |
|---|---|---|---|
| 2854899 | 7/1980 | Fed. Rep. of Germany | 181/156 |
| 3317518 | 11/1984 | Fed. Rep. of Germany | 381/159 |
| 1201682 | 1/1960 | France | 101/156 |
| 1225845 | 7/1960 | France | 181/156 |

*Primary Examiner*—Benjamin R. Fuller
*Attorney, Agent, or Firm*—Spensley Horn Jubas & Lubitz

[57] ABSTRACT

An acoustic apparatus for improved bass sound reproduction comprises a resonator, a vibrator, and a vibrator drive means. The resonator has a resonance radiation unit for radiating an acoustic wave by resonance, the vibrator has a diaphragm disposed in the resonator, the vibrator drive means has a motional feedback (MFB) means for detecting the movement of the diaphragm and negatively feeding back a motional signal corresponding to the movement of the diaphragm to the input side of the circuit, and the counteraction of the resonator on the diagram is canceled upon driving of the resonator whereby the vibrator may be invalidated as viewed from the resonator, and the vibrator and the resonator can be independently designed.

9 Claims, 23 Drawing Sheets

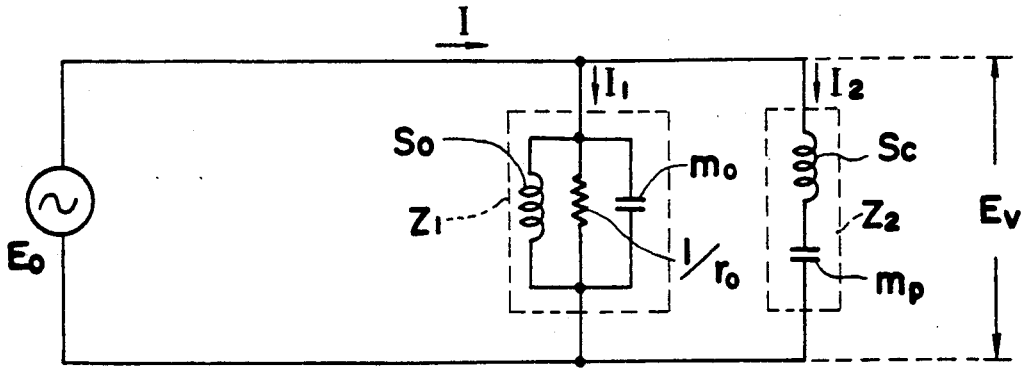
FIG. 4
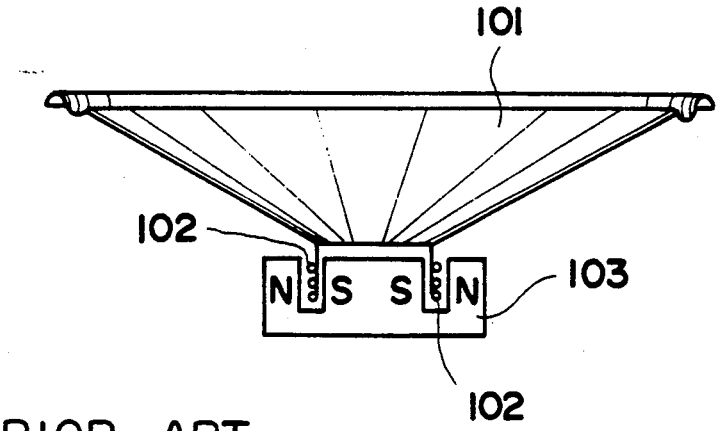
PRIOR ART
FIG. 5
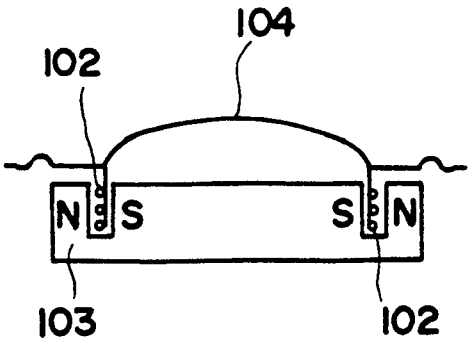
PRIOR ART FIG. 6

ACOUSTIC APPARATUS

BACKGROUND OF THE INVENTION

1. Field of the Invention

The present invention relates to an acoustic apparatus including or using a resonator as an acoustic radiation member.

2. Prior Art

A speaker system as one type of acoustic apparatus is arranged such that a speaker unit (vibrator) is disposed in a cabinet and is driven by an amplifier (AMP). Of reproduction characteristics of the speaker system, low-frequency reproduction characteristics are mainly determined by the volume of the cabinet.

A dynamic direct radiator speaker (dynamic cone speaker) as a typical direct radiator type speaker has a substantially conical diaphragm. The diaphragm is driven by a voice coil in a magnetic gap attached near the top of the cone. When such a speaker is used in the acoustic apparatus, a direct sound is radiated from the front surface of the diaphragm, and acoustic waves are also radiated from its rear surface. The phase of the acoustic waves from the front and rear surfaces are opposite to each other. Therefore, if a difference in propagation distance of the acoustic waves from the front and rear surfaces to a listener is almost an odd multiple of a half wavelength, sound pressures from these surfaces are in phase with each other, and are superposed.

However, if the difference in propagation distance of the acoustic waves is almost an even multiple of the half wavelength, the sound pressures cancel each other and are attenuated Thus, taking into consideration the fact that sounds having various wavelengths are radiated from the speaker, it is preferable that the sound from the rear surface does not reach the listener or the sound from the rear surface does not adversely influence the direct radiation sound from the front surface.

For this purpose, the direct radiator type speaker employs a baffle. As a baffle for shielding communication of sounds from the front and rear surface of the diaphragm, a plane baffle, back-opening cabinet type baffle, closed baffle, and the like are known, as shown in FIGS. 29A to 29C. Furthermore, as a baffle having a slightly different purpose than the above baffles, a phase inversion type (bass-reflex type) baffle shown in FIGS. 31A and 31B is known. These baffles will be described below.

FIG. 29A shows a sectional view of a plane baffle. In the Figure, a hole having the same size as a vibrator is formed in a single, wide flat plate 1. The vibrator is constituted by a dynamic electroacoustic transducer (dynamic speaker) having a substantially conical diaphragm 2 and a dynamic electoro-mechanical transducer 3, and is mounted in this hole at the diaphragm 2. The dynamic transducer 3 including a voice coil, a magnetic circuit, and the like is attached to the top portion of the cone of the diaphragm 2. According to this plane baffle, since a sound from the rear surface is shielded by the plate 1, if the plate 1 is assumed to have an infinite size, a perfect baffle effect can be obtained However, a plate having an infinite size is not realistic, and in practice, a plate 1 having a finite size is used. If a lowest frequency of sound pressure reproduction characteristics is set to be about 60 Hz, the plate 1 must be a 2×2 (m) square, and cannot be put into a practical use.

FIG. 29B is a sectional view of a back-opening cabinet type baffle As shown in the Figure, a hole is formed in a cabinet 4 opened its rear end. A vibrator constituted by a diaphragm 2 and a dynamic transducer 3 is mounted in this hole However, according to the back-opening cabinet type baffle, the speaker system must have a large size in order to obtain a necessary baffle effect. An air column in the cabinet 4 constitutes a resonance system, and impairs a transient response.

FIG. 29C is a sectional view of a closed baffle. As shown in the Figure, a hole is formed in the front surface of a closed cabinet 5, and a vibrator constituted by diaphragm 2 and a dynamic transducer 3 is mounted in this hole. With this structure, if the cabinet 5 can be perfectly prevented from being vibrated, the sound from the rear surface of the diaphragm 2 can be perfectly enclosed, thus obtaining a perfect baffle effect. However, air enclosed in cabinet 5 serves as an air spring, and gives an elasticity to the diaphragm 2. As a result, a resonance frequency as a whole undesirably becomes higher than that of the plane baffle.

This principle will be explained below with reference to FIG. 30. FIG. 30 shows a simplified electric equivalent circuit of the system shown in FIG. 29C. In FIG. 30, reference symbol $R_v$ denotes a DC resistance of a voice coil of the vibrator, and $m_o$, $S_o$, and $S_c$ have the following relationships:

$m_o$: equivalent mass of vibration system $S_o$: equivalent stiffness of vibration system $S_c$: equivalent stiffness of cabinet Reference symbol A denotes a force coefficient, which is given by $A=Bl_v$ where B is the magnetic flux density in a magnetic gap and $l_v$ is the length of the voice coil conductor A parallel resonance circuit $Z_1$ by an equivalent motional impedance of the unit vibration system and an equivalent motional impedance $A^2/S_c$ of the closed cabinet are connected in parallel with each other, and the parallel circuit is connected in parallel with an amplifier (not shown) through the voice coil resistance $R_v$ as a nonmotional impedance.

As can be seen from this electric equivalent circuit, a resonance frequency $f_{oc}$ of a whole system is increased to be higher than a lowest resonance frequency $f_o$ of the vibrator and is given by:

$$f_{oc}=f_o(1+S_c/S_o)^{\frac{1}{2}}$$

An equivalent Q value ($Q_{oc}$) of the whole system at the resonance frequency $f_{oc}$ has the following relationship with respect to a Q value ($Q_o$) of the vibrator itself at the lowest resonance frequency $f_o$ and is increased as:

$$Q_{oc}=Q_o(1+S_c/S_o)^{\frac{1}{2}}$$

Therefore, in order to improve low-frequency reproduction characteristics, the equivalent stiffness $S_c$ of the cabinet must be decreased. For this purpose, a large cabinet must be employed.

A bass-reflex type speaker system has a slightly different purpose from the above-mentioned baffles. FIGS. 31A and 31B are a perspective view and a sectional view of the bass-reflex type speaker system. As shown in FIGS. 31A and 31B, a hole is formed in a cabinet 6, and a vibrator consisting of a diaphragm 2 and a dynamic transducer 3 is mounted in this hole. An opening port 8 having a sound path 7 is arranged below the vibrator. In a conventional bass-reflex type speaker system according to a standard setting, a resonance frequency $f_{op}$ caused by an air spring in the cabinet 6 and an air mass of the sound path 7 is set to be lower than the lowest resonance frequency $f_o$ of the vibrator (speaker) which is assembled in the bass-reflex type cabinet At a frequency higher than the resonance frequency $f_{op}$ caused by the air spring and the air mass, the sound pressure from the rear surface of the diaphragm 2 has inverts its phase oppositely in the sound path 7, whereby the direct radiation sound from the front surface of the diaphragm 2 and the sound from the opening port 8 are consequently in phase with each other before the cabinet 6, thus increasing the sound pressure. As a result, according to an optimally designed bass-reflex type speaker system, the frequency characteristics of an output sound pressure can be expanded below the lowest resonance frequency of the vibrator. As indicated by an alternate long and two short dashed curve in FIG. 32, a uniform reproduction range can be extended wider than those of the infinite plane baffle and the closed baffle.

However, when uniform reproduction is realized by the bass-reflex type speaker system, various limitations are posed on the resonance Q value of a unit vibration system and the like, and only when these limitations are met, the characteristics shown in FIG. 32 can be obtained In this manner, in the conventional bass-reflex type speaker system, it is very difficult to obtain an optimal design condition.

On the other hand, an attempt is made to intentionally extremely lower the resonance frequency $f_{op}$ of the resonator regardless of the standard design idea of the bass-reflex type speaker system and paying attention to only an acoustic radiation power from the opening port.

However, since the bass reproduction power is closely related to the volume of the cabinet, anyhow, a larger cabinet must have been employed as in the closed baffle in order to achieve low-frequency reproduction. This situation will be explained in detail below with reference to FIG. 33.

FIG. 33 shows a simplified electric equivalent circuit of the bass-reflex type speaker system shown in FIGS. 31A and 31B. In FIG. 33, reference symbols A, $R_v$, $m_o$, $S_o$ and $S_c$ are the same as those in FIG. 30, and $m_p$ corresponds to an equivalent mass of the sound path (port). A parallel resonance circuit $Z_1$ by an equivalent motional impedance of the unit vibration system and a series resonance circuit $Z_2$ by an equivalent motional impedance of a port resonance system are connected in parallel with each other, and this parallel circuit is connected in parallel with a driving amplifier (not shown) through the voice coil resistance $R_v$ as a non-motional impedance.

As can be seen from this electric equivalent circuit, the bass-reflex type speaker system includes two resonance systems according to its major characteristic feature. The impedance characteristics of this speaker system represent a double-humped curve having a total of three resonance points, i.e., two maximum peaks and one minimum peak therebetween. The resonance point of the minimum peak corresponds to the port resonance system (the above-mentioned closed baffle has only one resonance system, and its impedance characteristics exhibit a single-humped curve including only one resonance point). In the bass-reflex type speaker system, the voice coil resistance $R_v$ of the vibrator (unit) serves as both a damping resistance of the parallel resonance circuit $Z_1$ of the vibrator side and the series resonance circuit $Z_2$ of the opening port (duct) side. For this reason, the parallel and series resonance circuits $Z_1$ and $Z_2$ mutually interfere with each other.

As an example of mutual interference or mutual dependency, if a vibrator having a strong magnetic circuit is used, a resonance Q value of the vibrator is reduced, while the resonance Q value of the opening port is increased. In contrast to this, if a vibrator having a weak magnetic circuit is used, the opposite situation to the above occurs In an essential design of the bass-reflex type speaker system, an optimal point capable of obtaining uniform low-frequency reproduction characteristics must be selected under the conflicting mutual dependency condition.

Assume that the volume of the cabinet is reduced. In this case, the lowest resonance frequency $f_o$ of the unit vibration system exhibits the same tendency as that of the closed baffle, and as a result, is increased The low-frequency reproduction characteristics will finally come to be improved to some extent by the acoustic radiation effect of the opening port. However, if the size of the cabinet is reduced, it cannot be avoided that the low-frequency reproduction power will be decreased as the whole system even in the bass-reflex type speaker system.

In particular, when the resonance frequency $f_{op}$ of the port resonance system is intentionally decreased from standard setting, as described above, the opening port must be more elongated as the cabinet is smaller in size Therefore, the Q value becomes very small due to an increase in mechanical resistance of air in the port. An extreme decrease in resonance Q value leads to loss of the acoustic radiation power from the opening port. As a result, the function of the opening port as a resonance duct is lost, and the presence of the opening port becomes meaningless. That is, if the size of the cabinet is reduced, bass reproduction is essentially impossible.

As has been schematically described above, in the conventional acoustic apparatus, various countermeasures are taken in order to allow low-frequency reproduction.

The plane baffle, back-opening baffle, and closed baffle shown in FIGS. 29A to 29C are designed such that radiation sounds from the rear surface of the diaphragm do not reach a listener in front of the speaker system as unnecessary sounds. However, in order to improve the bass reproduction characteristics with these baffles, the apparatus (cabinet) will inevitably be made large in size, and even if it is made so to a certain feasible extent, its low-frequency reproduction characteristics will be insufficient.

In the bass-reflex type speaker system shown in FIGS. 31A and 31B, the phase of the backward sound is inverted by the opening port, so that in particular, a bass range of a direct radiation sound from the front surface of the diaphragm is compensated for. For this reason, the resonance system which is originally very hard to deal with is undesirably formed on the two portions, i.e., the diaphragm and the opening port. In order to obtain a satisfactory bass-reflex effect according to the standard setting, the optimal condition of the system must be very critically set while taking the mutual dependency condition of these two resonance systems. Although various attempts have been made in this respect as disclosed in Japanese Patent Publication No. sho 46-12670 and Japanese Utility Model Publication No. sho 54-35068, these attempts could not eliminate difficulty on design.

In order to improve the low-frequency reproduction characteristics, the cabinet undesirably becomes bulky, whether the optimal design of said speaker system has been achieved or not.

In some bass-reflex type speaker systems, the resonance frequency fop of the port resonance system is intentionally decreased from its standard setting. However, if the size of the cabinet is to be reduced, the port resonance system will hardly contribute to acoustic radiation, thus incurring a fatal drawback.

Therefore, when a bass reproduction power of a certain level or higher is to be obtained according to any of the prior arts, the resulting cabinet will inevitably become large in size. As a result, it is difficult to employ an acoustic apparatus having a cabinet of a proper volume and excellent low-frequency reproduction characteristics in a variety of applications such as in halls, rooms, vehicles, and the like.

As is so in the bass-reflex speaker system described above, in an acoustic apparatus, a resonance phenomenon is utilized in a variety of forms. FIGS. 34 to 37 show typical prior art examples in which the resonance phenomenon are utilized.

In a first prior art shown in FIG. 34, a resonator 81 is partitioned into two chambers, i.e., A and B chambers, by a partition wall 82. A dynamic electroacoustic transducer (dynamic speaker) 83 serving as a vibrator is attached to a hole of the partition wall 82. Opening ducts 84*a* and 84*b* are respectively provided to the A and B chambers, and resonance acoustic waves are radiated outwards from these ducts, as indicated by arrows in the Figure. The A and B chambers respectively have resonance frequencies $f_{oa}$ (Hz) and $f_{ob}$ (Hz) determined by the volumes of cavities (i.e. the volumes of chambers A and B), the dimensions of the opening ducts 84*a* and 84*b*, and the like. Therefore, when the speaker 83 is driven by an amplifier (not shown), a resonance phenomenon occurs by the vibration of a diaphragm, and an output energy at that time has maximum values near the above-mentioned resonance frequencies. As a result, the resonance acoustic waves having sound pressure-frequency characteristics illustrated in FIG. 35 can be obtained In a second prior art shown in FIG. 36, a dynamic electro-acoustic transducer (speaker) 86 serving as a vibrator is attached to a resonance chamber 85' defined by a cabinet 85, and an opening 87 for externally radiating a resonance acoustic wave is formed in the chamber 85'. Another dynamic electro-acoustic transducer (speaker) 88 is separately provided to the cabinet 85, so that an acoustic wave is directly radiated outwards therefrom. In this acoustic apparatus, when the speaker 86 is driven by an amplifier (not shown), a resonance phenomenon occurs in the resonance chamber 85' due to the vibration of a diaphragm of the speaker 86. Therefore, acoustic reproduction illustrated in FIG. 37 is made from the opening 87 to have a peak sound pressure near a resonance frequency $f_o$ inherent in the resonance chamber 85'.

However, according to conventional acoustic apparatuses, the vibrator undesirably causes a decrease in resonance Q value of the resonator serving as an acoustic radiation member. This is because the speaker as the vibrator has an inherent internal impedance $Z_v$, and the internal impedance becomes to an element which damps the resonance of the resonator. In this manner, as the resonance Q value becomes low, radiation power of the resonance acoustic wave becomes inevitably low, and the presence of the resonator in the acoustic apparatus becomes meaningless.

If the resonance frequency is decreased while rendering the resonator compact, the opening duct must be elongated. Accordingly, the acoustic resistance (mechanical resistance) of the opening duct is inevitably increased, and the resonance Q value is decreased further. For this reason, the acoustic radiation power is further decreased due to the decrease in the resonance Q value, and the acoustic apparatus is not suitable for a practical use.

As a result, neither of the conventional apparatuses shown in FIGS. 34 and 36 have sufficient acoustic radiation power. If a certain level of power is to be maintained, the cabinet becomes extremely large.

SUMMARY OF THE INVENTION

The present invention has been made in consideration of the above situation, and has for its first object to provide an acoustic apparatus which can appropriately and independently set a volume of a cabinet or the like constituting the acoustic apparatus and low-frequency reproduction characteristics, and can remove or reduce a mutual dependency condition of a vibrator and a resonator.

It is a second object of the present invention to provide an acoustic apparatus which uses a resonator as an acoustic radiation member, can realize sufficient acoustic radiation power and can be rendered compact.

The acoustic apparatus in a first aspect of the present invention comprises a resonator having a resonance radiation unit for radiating an acoustic wave by resonance, a vibrator disposed in the resonator, and a vibrator drive means for driving the vibrator. The vibrator has a diaphragm having a direct radiator portion for directly radiating an acoustic wave outwards, and a resonator driver portion for driving the resonator. The vibrator drive means has a motional feedback (MFB) means for detecting the movement of the diaphragm and negatively feeding back motional signal corresponding to the movement to the input side of the vibrator drive means.

With the above arrangement, the resonator is driven by the resonator driver portion of the vibrator. Therefore, an acoustic wave is directly radiated outwards from the direct radiator portion of the vibrator, and an acoustic wave by resonance is radiated outwards from the resonance radiation unit of the resonator.

As is seen from an electric equivalent circuit, the vibrator comprises a series circuit constituted by an internal impedance inherent in the vibrator (mainly D resistance of a voice coil) and an equivalent motional impedance contributing to practical vibration. The motional signal represents the voltage applied to the equivalent motional impedance, its differential or integral output, or the like, and corresponds to the real movement of diaphragm of the vibrator, e.g. velocity, acceleration, deviation (or amplitude), or the like of the vibration. The motional feedback means provided in the vibrator drive means detects said motional signal and negatively feed it back to the input side of the vibrator drive means. Therefore, the drive condition of the vibrator drive means is brought under follow-up control so that a signal in an amount corresponding to drive input is always correctly transmitted as the voltage applied to the equivalent motional impedance, or its deferential or integral voltage. More specially, the vibrator drive means equivalently appears to directly and linearly drive the equivalent motional impedance itself of the vibrator. In any case, the internal impedance inherent in the vibrator existing between the vibrator drive means and the equivalent motional impedance of the vibrator apparently reduced in degree of influence. Therefore, the internal impedance inherent in the vibrator can be apparently reduced (or preferably invalidated). Still more, this reduction or invalidation of the internal impedance essentially relates a negative feedback quantity. For example, if the negative feedback quantity is $\beta$, the reduction or invalidation operation is performed so as to reduce the internal impedance to $1/\beta$. For this reason, although the value of the internal impedance is changed due to heat during operation, degree of the reduction or invalidation does not significantly vary if said $\beta$ is large to some extent. Since the reduction or invalidation is realized by a detecting compensation loop applying the negative feedback, even in an ideal case wherein the $\beta$ is infinity, the internal impedance merely cancelled perfectly. Therefore, so-called excessive compensation, where the internal impedance is excessively cancelled and the circuit as a whole becomes in a negative impedance mode, cannot be caused.

Due to the effect of the reduction or invalidation of the internal impedance, the vibrator becomes an element constituted substantially only by the equivalent motional impedance. In another word, the vibrator becomes an element responsive to only an electrical drive signal input, and is substantially no longer a resonance system. At the same time, the volume of the resonator does not influence low-frequency reproduction power of the vibrator. Thus, if the cabinet is rendered compact, bass reproduction can be realized in the direct radiation portion side without including distortion due to a transient response of the vibrator. In the resonator, since the Q value near the resonance frequency can be set a sufficiently large value without decrease caused by the internal impedance inherent in the vibrator, if the cabinet is rendered compact, super-bass (heavy bass) reproduction with a sufficient sound pressure can be realized. The Q value can be set by an equivalent resistance of a resonance radiation unit (opening port), and the resonance frequency can be set by adjusting an equivalent mass of the resonance radiation unit (port). Therefore, the volume of the resonator does not influence the low-frequency reproduction power.

As shown in the mechanical or electric equivalent circuit, since a vibration system constituted by the vibrator and a resonance system constituted by the resonator can be dealt with independently as much as possible (preferably, completely independently), the mutual dependency between the above systems on design can be reduced (or preferably, removed) without causing any problem. Thus, designing can be much facilitated.

As described above, the compact size and super-bass reproduction can be simultaneously achieved, and designing can be facilitated.

The acoustic apparatus in a second aspect of the present invention comprises a resonator having a resonance radiation unit for radiating an acoustic wave by resonance, a vibrator constituting a part of the resonator and disposed in the resonator, a vibrator drive means having a motional feedback (MFB) means for detecting a motional signal corresponding to the movement of the vibrator and negatively feeding back the motional signal to the input side of the vibrator drive means.

With the above arrangement, upon operation of the motional feedback means in the vibrator drive means, the drive condition of the vibrator drive means is brought under follow-up control so that a signal in an amount corresponding to a drive input is always correctly transmitted to the equivalent motional impedance side, and the internal impedance inherent in the vibrator can be apparently reduced or invalidated. Therefore, the vibrator becomes an element responsive to only the electrical drive signal input. For this reason, the vibrator performs an ideal operation without causing a transient response at all. In addition, the resonance system of the vibrator will not substantially function as such, and the vibrator equivalently becomes an wall of the resonator. Therefore, the presence of the vibrator is invalidated when viewed from the resonator, and the internal impedance inherent in the vibrator is not a factor which causes a decrease in resonance Q value of the resonator. For this reason, the resonance Q value of the resonator can be extremely high. Although the acoustic resistance of the resonator is increased if the resonator is rendered compact and the resonance frequency is lowered, according to the present invention, even in a case wherein the resonance Q value becomes very small in a conventional drive method, the resonance Q value is not decreased by the presence of the vibrator. As a result, the resonance Q value can be kept at a sufficiently high value, and sufficient acoustic radiation power of the resonator can be maintained.

As described in the above explanation about the first aspect of this invention, since said reduction or invalidation of the internal impedance is realized by a negative feedback operation, the internal impedance cannot be excessively cancelled or compensated.

By above-mentioned reason, improvement of radiation power of a resonance acoustic wave and a compact resonator can be simultaneously realized.

BRIEF DESCRIPTION OF THE DRAWINGS

FIG. 4 is an electric equivalent circuit diagram of FIG. 1A;

FIGS. 5 to 9 are views for explaining some examples of dynamic speakers;

DETAILED DESCRIPTION OF THE PREFERRED EMBODIMENTS

Figure 1A:
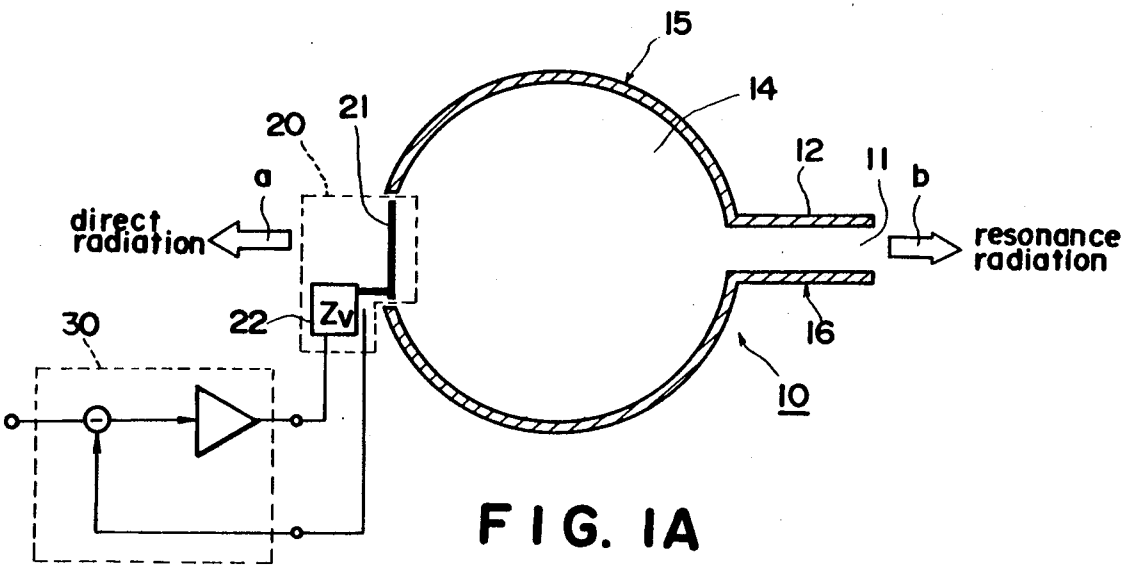
FIGS. 1A and 1B are diagrams for explaining a basic arrangement of a first embodiment of the present invention.

Preferred embodiments of the present invention will be described hereinafter with reference to FIGS. 1 to 28. The same reference numerals in the drawings denote the same parts to avoid repetitive descriptions.

Figure 1B:
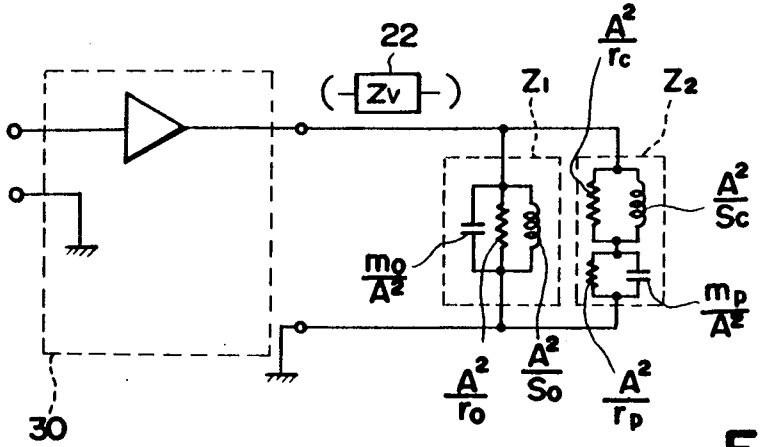

FIGS. 1A and 1B show a basic arrangement of a first embodiment of the present invention. As shown in FIG. 1A, in this embodiment, a Helmholtz resonator 10 having an opening port 11 and a neck 12 serving as a resonance radiation unit is used as a resonator which is an acoustic radiation member. In the Helmholtz resonator 10, a resonance phenomenon of air is caused by a closed cavity (hollow drum) 14 formed in a body portion 15 and a short tube or duct 16 constituted by the opening port 11 and the neck 12. The resonance frequency $f_{op}$ is given by:

$$f_{op}=c(S/lV)^{1/2}/2\pi \quad (1)$$

where c: velocity of sound

S: sectional area of duct 16 l: length of neck 12 of duct 16

V: volume of cavity 14

In the acoustic apparatus of this embodiment, a vibrator 20 constituted by a diaphragm 21 and a transducer 22 is attached to the body portion 15 of the resonator 10. The transducer 22 is connected to a vibrator driver 30, which comprises a motional feedback (MFB) unit for detecting, by using any appropriate method, motional signal corresponding to movement of the diaphragm 21 and negatively feeding back the signal to input side.

FIG. 1B shows an arrangement of an electric equivalent circuit of the acoustic apparatus shown in FIG. 1A. In FIG. 1B, a parallel resonance circuit $Z_1$ corresponds to an equivalent motional impedance of the vibrator 20, $r_o$ designates an equivalent resistance of the vibration system of the vibrator 20; $S_o$, an equivalent stiffness of the vibration system; and $m_o$, an equivalent mass of the vibration system. A series resonance circuit $Z_2$ corresponds to an equivalent motional impedance of the Helmholtz resonator 10, $r_c$ designates an equivalent resistance of the cavity 14; $S_c$, an equivalent stiffness of the cavity 14; $r_p$, an equivalent resistance of the duct 16; and $m_p$, an equivalent mass of the duct 16. In FIG. 1B, reference symbol A denotes a force coefficient. For example, if the vibrator 20 is a dynamic direct radiation speaker, $A=Bl_v$ where B is the magnetic flux density in the magnetic gap, and $l_v$ is the length of the voice coil conductor. Furthermore, in the Figure, $Z_v$ designates an inherent internal impedance of the transducer 22. For example, if the vibrator is a dynamic direct radiation speaker, the impedance $Z_v$ mainly serves as a DC resistance of the voice coil, and includes a small inductance.

Figure 2:
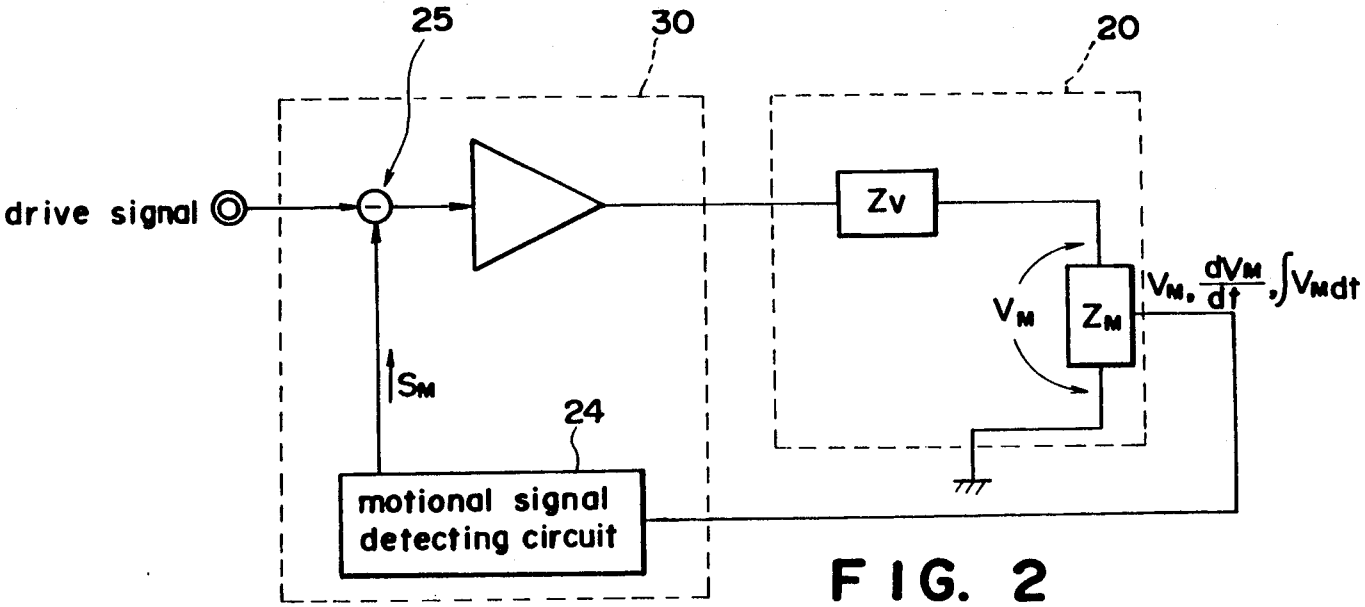
FIG. 2 is a conceptional diagram showing motional feedback function.

As indicated in FIG. 2, the original impedance equivalent circuit of this vibrator 20 is composed of a series circuit wherein said equivalent motional impedance $Z_M$ and the inherent internal impedance $Z_v$ of the transducer 22 are included, as viewed from electric equivalency. The motional signal $S_M$ to be detected from the equivalent motional impedance $Z_M$ includes the voltage across the equivalent motional impedance, the differential output or integral output thereof; these factors so included correspond respectively to the vibration velocity, vibration acceleration and vibration displacement (amplitude) of the diaphragm 21. The motional feedback constitution or arrangement provided in the vibrator driver 30 has a motional signal detecting unit 24 for detecting as the motional signal an amount corresponding to any one of said factors, and a motional signal $S_M$ so detected is negatively fed back through a feedback unit 25 to the input side of the vibrator driver 30.

The operation of the acoustic apparatus with the arrangement shown in FIG. 1A will be briefly described below.

When a drive signal is supplied from the vibrator driver 30 having a motional feedback function to the transducer 22 of the vibrator 20, the transducer 22 electromechanical converts the drive signal so as to reciprocally drive the diaphragm 21 forward and backward (in the right and left directions in the Figure). The diaphragm 21 mechanical-acoustic converts this reciprocal motion. Since the vibrator driver 30 has a motional feedback unit, if the amount of negative feedback is extremely large, the condition of driving the vibrator driver 30 is brought under follow-up control so that a signal in an amount corresponding to the drive input is always correctly transmitted as the terminal voltage across said equivalent motional impedance, the differential voltage or integral voltage of said terminal voltage.

In other words, motional voltages, etc., applied to the equivalent motional impedance are controlled so that they correspond to the drive input in a relation of 1:1. Accordingly, the vibrator driver 30 is apparently become equivalent to subjecting the equivalent motional impedance itself of the vibrator 20 directly to linear, integral or differential driving, and the internal impedance inherent in the transducer 22 is apparently invalidated. Therefore, the transducer 22 drives the diaphragm 21 faithfully in response to the drive signal from the vibrator driver 30, and independently supplies a drive energy to the Helmholtz resonator 10. In this case, the front surface side (the left surface side in FIG. 1A) of the diaphragm 21 serves as a direct radiator portion for directly radiating acoustic waves outwards, and the rear surface side (the right surface side in FIG. 1A) of the diaphragm 21 serves as a resonance driver portion for driving the Helmholtz resonator 10.

For this reason, as indicated by an arrow a in FIG. 1A, an acoustic wave is directly radiated from the diaphragm 21, and air in the Helmholtz resonator 10 is resonated, so that a super-bass acoustic wave having a sufficient sound pressure is resonated and radiated from the resonance radiation unit as indicated by an arrow b. By adjusting an air equivalent mass in the duct 16 of the Helmholtz resonator 10, the resonance frequency $f_{op}$ is set to be lower than the reproduction frequency range of the vibrator 20, and by adjusting the equivalent resistance of the duct 16, the Q value is set to be an appropriate level, so that a sound pressure of an appropriate level can be obtained from the opening port 11. By these adjustments, sound pressure-frequency characteristics shown in, e.g., FIG. 3 can be obtained.

This will be explained with reference to the equivalent circuit shown in FIG. 4.

FIG. 4 shows the electric equivalent circuit of FIG. 1B in a more simplified form. In other words, FIG. 4 is an equivalent circuit diagram wherein the equivalent resistances $r_c$ of the cavity 14 of the resonator 10 as well as the equivalent resistance $r_p$ of the duct 16 is disregarded since said equivalent resistances are sufficiently small and the reciprocals thereof are extremely large and wherein the internal impedance $Z_v$ is practically invalidated ($Z_v=0$) by the motional feedback unit. As shown in the Figure, the parallel resonance circuits $Z_1$ and the series resonance circuits $Z_2$ are respectively short-circuited in an AC (alternate current) manner with zero impedance and they may each be deemed to be an entirely independent resonance system. In FIG. 4, if I denotes a current flowing through the circuit, and $I_1$ and $I_2$ denote currents flowing through the parallel and series resonance circuits $Z_1$ and $Z_2$, respectively, equations (2) and (3) below are established:

$$I_1=E_0/Z_1 \quad (2)$$

$$I_2=E_0/Z_2 \quad (3)$$

Strictly examining a resonance system of the vibrator 20, the two ends of the parallel resonance circuit $Z_1$ formed by the equivalent motional impedance are short-circuited with a zero impedance in an AC manner. Therefore, the parallel resonance circuit $Z_1$ is essentially no longer a resonance circuit. More specifically, the vibrator 20 linearly responds to a drive signal input in real time, and faithfully electroacoustic converts an electric signal (drive signal) $E_o$ without a transient response. In the vibrator 20, the concept of a lowest resonance frequency $f_o$ which is obtained when the vibrator is simply mounted on the Helmholtz resonator 10 is not applicable. This is because the two ends of the parallel resonance circuit $Z_1$ of the vibrator 20 are short-circuited with a zero impedance in an AC manner. (In the following description, "a value corresponding to the lowest resonance frequency $f_o$ of the vibrator 20" refers to the above-mentioned concept which is not essentially applicable any longer.) The vibrator 20 and the Helmholtz resonator 10 are independent of each other, and the vibrator 20 and the duct 16 are also independent of each other. For this reason, the vibrator 20 functions independently of the volume of the cavity 14 of the Helmholtz resonator 10, the inner diameter of the opening port 11, the length of the neck 12, and the like (i.e., independently of the equivalent motional impedance $Z_2$ of the port resonance system).

The parallel and series resonance circuits $Z_1$ and $Z_2$ are present as resonance systems independently of each other. Therefore, if the Helmholtz resonator 10 is designed to be compact in order to reduce the size of the system, or when the duct 16 is designed to be elongated in order to reduce the Q value of the port resonance system as will be described later, the design of the unit vibration system is not influenced by the port resonance system at all, and the value corresponding to the lowest resonance frequency $f_o$ of the unit vibration system is not influenced by the port resonance system at all, either. For this reason, easy designing free from the mutual dependency condition is allowed.

From another point of view, since the unit vibration system $Z_1$ is not effectively a resonance system, if the drive signal input is zero volt, the diaphragm 21 becomes a part of the wall of the resonator 10. As a result, the presence of the diaphragm 21 can be ignored when the port resonance system is considered.

From still another point of view, in the acoustic apparatus of this embodiment, the port resonance system is only one resonance system, and exhibits single-humped characteristics similar to those of the closed baffle.

In the parallel resonance system, the Q value given by the following relation becomes zero for the parallel resonance circuit $Z_1$:

(load resistance)/(resonance impedance)

Q=0 in the unit vibration system has some other significances.

First, the vibrator 20 equivalently forming the parallel resonance circuit $Z_1$ becomes a speaker which is driven by a current source given by $E_v/(A^2/r_o)$ which is determined by the input voltage $E_v$ and a resistance $A^2/r_o$ of the parallel resonance circuit $Z_1$. A current drive region in an electrical sense is equivalent to a velocity drive region in a mechanical sense, and frequency characteristics of an acoustic wave near the value corresponding to the lowest resonance frequency $f_o$ of this speaker are 6 dB/oct. In contrast to this, characteristics in a normal voltage drive state are 12 dB/oct.

Second, the diaphragm 21 can be in a perfectly damped state. More specifically, for a counteraction caused by driving the diaphragm 21, follow-up control is made to overcome the counteraction by effecting the motional feedback to increase or decrease the drive current. Therefore, for example, when an external force is applied to the diaphragm 21, a counter drive force acts at that moment until a state balanced with the external force is established (active servo).

The resonance system constituted by the cavity 14 and the duct 16 will be examined below with reference to FIG. 4.

As shown in the Figure, the two ends of the series resonance circuit $Z_2$ are also apparently short-circuited with zero Ω in an AC manner. However, in this case, unlike the parallel resonance circuit $Z_1$ described above, the significance of the resonance system is not lost at all. Conversely, the Q value of the resonance system becomes extremely large (if approximate to an ideal state $Q \approx \infty$). A driving operation of a virtual acoustic source (speaker) constituted by the opening port 11 of the Helmholtz resonator 10 is achieved by a displacement (vibration) of the diaphragm 21 in practice. It is considered for the equivalent circuit shown in FIG. 4 that a drive energy is supplied from the drive source $E_v$ in parallel with the vibrator 20. For this reason, by setting the resonance frequency and the resonance Q value in the resonator independently of the vibrator, super-bass reproduction with a sufficient sound pressure can be achieved by a compact system.

Here, since the series resonance circuit $Z_2$ of the port resonance system is present completely independently of the parallel resonance circuit $Z_1$ of the unit vibration system, the design specifications of the cavity 14 and the duct 16 of the Helmholtz resonator 10 are not influenced by the design specifications of the vibrator 20. Therefore, easy designing free from the mutual dependency condition is allowed.

For the virtual speaker (the acoustic source by the Helmholtz resonator 10), from equations (2) and (3) described above, the current I flowing through the transducer 22 of the vibrator is:

$$\begin{aligned} I &= I_1 + I_2 \\ &= (1/Z_1 + 1/Z_2)\, E_0 \end{aligned} \tag{4}$$

From equation (3), $Z_2$ value approximates 0 near the resonance frequency $f_{op}$ of the opening port 11 in a state wherein the port resonance system causes Helmholtz resonance (however, $Z_2$ is damped by a resistance component in practice), and hence, the current $I_2$ can be flowed by a voltage of a very small amplitude.

Since the value corresponding to the lowest resonance frequency $f_o$ of the vibrator 20 is higher than the resonance frequency $f_{op}$ of the opening port 11, the $Z_1$ value is sufficiently large near the resonance frequency $f_{op}$. For this reason, equation (4) can be rewritten as:

$$I = I_1 + I_2 \approx I_2$$

Almost all the current flowing through the transducer 22 of the vibrator 20 contributes to driving of the port resonance system (virtual speaker). The port resonance system is driven by a small-amplitude voltage (large current), and this means that the transducer 22 connected in parallel therewith is also driven by the small-amplitude voltage. Therefore, the diaphragm 21 performs a small-amplitude operation. In this case, since the diaphragm 21 performs the small-amplitude operation, a nonlinear distortion which usually occurs in a large-amplitude operation cf a dynamic cone speaker can be effectively eliminated in, particularly, a super-bass range.

In the equivalent circuit shown in FIG. 4, the resonance Q value of the series resonance circuit $Z_2$ becomes infinite because of the series resonance system unlike the parallel resonance circuit $Z_1$ described above. In this case, the resonance Q value is accurately calculated based on the equivalent circuit shown in FIG. 1B:

$$Q = (m_p S_c)^{\frac{1}{2}} / (r_c + r_p)$$

Normally, $r_c$ and $r_p$ are very small, and if they are ignored as zero, the same result is also obtained. Therefore, if the Q value is set to be an appropriate value, a sufficient sound pressure can be obtained by this virtual speaker.

The Q value of the Helmholtz resonator 10 can be normally controlled easier than the Q value of a speaker unit, and can be decreased as needed. For example, when the Helmholtz resonator 10 is rendered compact, the resonance frequency $f_{op}$ of the resonance system of the opening port 11 can be decreased by decreasing the sectional area S of the opening port 11 or increasing the length l of the neck 12 in equation (1) described above:

$$f_{op} = c(S/lV)^{\frac{1}{2}}/2\pi$$

This means that in the acoustic apparatus of this embodiment, setting for making the system compact and achieving super-bass reproduction becomes a factor for appropriately decreasing the Q value. More specifically, since elongation of the duct 16 amounts to an increase in mechanical resistance (acoustic resistance) due to an air friction, and $A^2/r$ in the equivalent circuit shown in FIG. 1B is decreased, the Q value of the series resonance circuit $Z_2$ on the side of the Helmholtz resonator 10 is decreased, and as a result, the damping characteristics can be appropriately improved. This point forms a remarkable contrast with a conventional bass-reflex type speaker system wherein when a resonance frequency of an opening port is decreased, the Q value of the resonance system is extremely decreased, and at last, acoustic radiation power of the port is lost.

In addition, $A^2/r_c$ is decreased by inserting a sound absorbing material in the cavity 14 of the Helmholtz resonator 10 so as to control the Q value to be a desired value. It is important that even if the Q value of the port resonance system is controlled under the condition of making the resonator (or cabinet) compact, the unit vibration system is not influenced.

Figure 3:
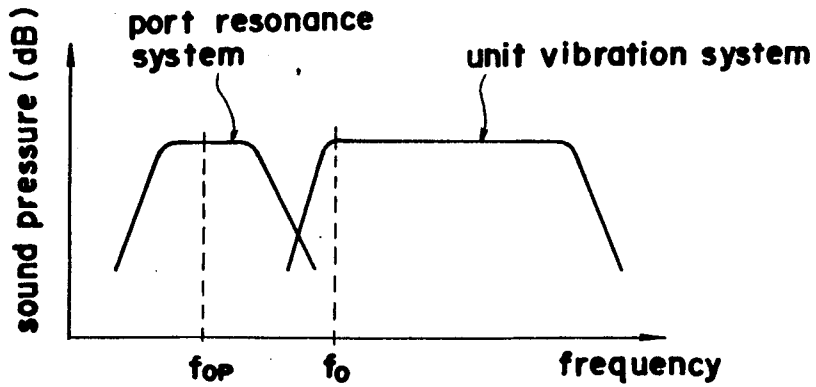
FIG. 3 is a graph showing sound pressure-frequency characteristics.

As can be seen from the above description, according to this embodiment, by differentiating in Q value the resonance frequency $f_{op}$ of the resonator 10 from the value corresponding to the lowest resonance frequency $f_o$, especially setting the fop to be lower than the $f_o$, the sound pressure-frequency characteristics shown in FIG. 3 can be readily realized by a compact apparatus (cabinet). The Q value is about zero near the value corresponding to the lowest resonance frequency $f_o$ of the unit vibration system expressed by the parallel resonance circuit $Z_1$, and the Q value of the series resonance circuit $Z_2$ can be desirably set near the resonance frequency $f_{op}$ of the port resonance system. In this case, in the whole apparatus, the port resonance system is the only resonance system, and the single-humped characteristic as in the conventional closed baffle is obtained.

It is important that the designing of the unit vibration system and the port resonance system can be independently performed. Thus, the opening port 11 serves as a virtual speaker which operates independently of the vibrator 20 while the opening port 11 is driven by the vibrator 20.

Although the virtual speaker can be realized with a small diameter corresponding to the diameter of the opening port, it corresponds to a very large-diameter speaker as an actual speaker in view of its bass reproduction power, and can provide remarkable effects for dimensional efficiency or sound source concentration. As a matter of course, the virtual speaker can be realized without any actual speakers In this sense, cost efficiency is very large. The virtual speaker includes not an actual diaphragm but a virtual diaphragm constituted by only air, and can be an ideal one.

In addition, the present invention is also characteristic of so-called excessive compensation being not caused at all. The motional feedback is follow-up controlled so that a signal in an amount corresponding to the drive input is correctly transmitted to the equivalent motional impedance side, thereby to apparently invalidate the internal impedance. The reduction or invalidation of the internal impedance is realized by detecting a motional signal corresponding to the movement of the diaphragm and putting the drive condition under negative feedback control so that said signal always corresponds to the the drive input, and the magnitude of the internal impedance is reduced to $1/\beta$ when the amount of negative feedback is $\beta$. In other words, the internal impedance is completely cancelled under an ideal condition wherein said $\beta$ is infinitely great, and there cannot, in principle, be caused excessive compensation which exhibits negative impedance as a whole due to cancellations excessively caused. Further, even in a case where the internal impedance varies due to the heat generation of a voice coil or the like, said internal impedance will not greatly vary in the degree of reduction and invalidation thereof; for this reason, it is not necessary at all to change the degree of motional feedback (that is, to effect temperature compensation).

In the above explanation of the basic arrangement, it is assumed that the internal impedance $Z_v$ is completely invalidated ($Z_v=0$) by the motional feedback drive, but sufficient effects of this invention are obtained by effectively reducing $Z_v$. This is because the resonance Q value of the port resonance system is increased as the effective value of the internal impedance $Z_v$ decreases, and the correlation between the unit vibration system and the port resonance system gradually disappears as the effective value of the internal impedance $Z_v$ decreases.

Further, such reduction of $Z_v$ will more or less be made if the amount $\beta$ of negative feedback of the motional signal is a finite value other than infinity $\infty$, and, in fact, if said amount $\beta$ is made large to a certain extent, it will be possible to fully reduce or invalidate the internal impedance.

Various examples which can be applied to the basic arrangement described above with reference to FIGS. 1 to 4 will be explained below.

The resonator is not limited to one shown in FIG. 1A. For example, the shape of the cavity or body portion is not limited to a sphere but can be a rectangular prism or cube. The volume of the resonator is not particularly limited, and can be designed independently of the unit vibration system. For this reason, the resonator can be rendered compact, resulting in a compact cabinet. The sectional shapes of the opening port and the neck constituting the resonance radiation unit are not particularly limited. For example, a sound path may extend externally as shown in FIG. 1A or may be housed in the cavity. The neck 12 may be omitted, so that an opening is merely present. In addition, a plurality of openings may be formed. Furthermore, the resonance frequency $f_{op}$ can be appropriately set considering the correlation between the sectional area of the opening port and the length of the neck. Since the sectional area of the opening port can be appropriately set considering the correlation with the length of the neck, the opening of the port is reduced, so that a virtual bass-range speaker (woofer) can have a small diameter. Thus, a sound source can be concentrated to improve a sense of localization.

Various types of vibrator (electroacoustic transducer) such as dynamic type, electromagnetic type, piezoelectric type, and electrostatic type vibrators can be adopted, as shown in FIGS. 5 to 12.

Diaphragms of dynamic speakers include cone, dome, ribbon, entire-surface drive, and hile driver types, as shown in FIGS. 5 to 9. A cone type dynamic speaker has a conical cone 101 as a diaphragm, as shown in FIG. 5, and a voice coil 102 is fixed near the top of the cone 101. The voice coil 102 is inserted in a magnetic gap formed in a magnetic circuit 103. A dome type dynamic speaker shown in FIG. 6 is basically the same as the cone type dynamic speaker shown in FIG. 5, except that the diaphragm comprises a dome 104.

Figure 7:
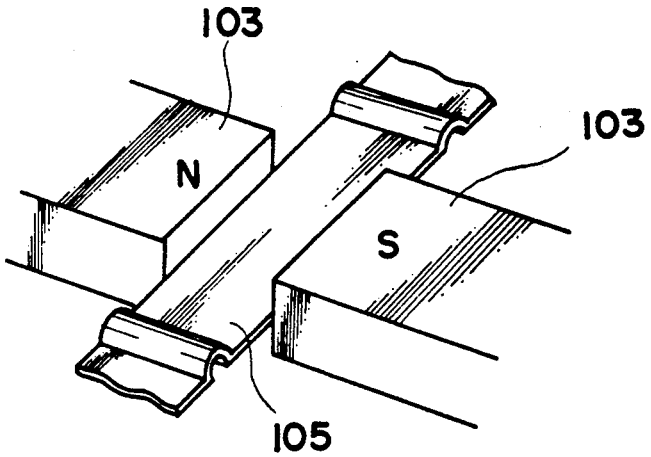
PRIOR ART FIG. 7

A ribbon type dynamic speaker is arranged such that a ribbon diaphragm 105 is disposed in a magnetic gap of a magnetic circuit 103, as shown in FIG. 7. In a speaker of this type, a drive current is flowed in the longitudinal direction of the ribbon diaphragm 105, so that the diaphragm 105 is vibrated forward and backward (upward and downward in FIG. 7), thereby generating an acoustic wave. Therefore, the ribbon diaphragm 105 serves as both the voice coil and the diaphragm.

Figure 8:
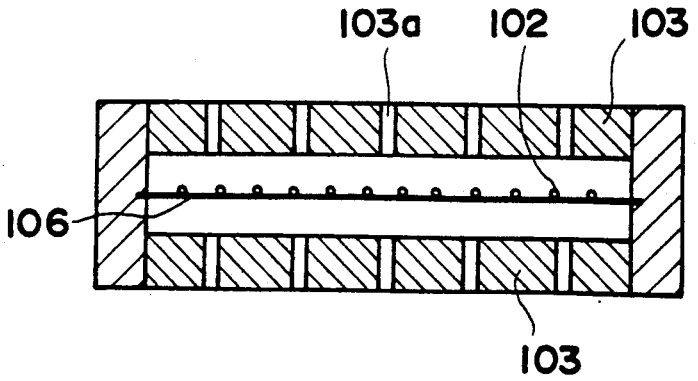
PRIOR ART FIG. 8

An entire-surface drive type dynamic speaker is arranged such that parallel magnetic plates 103, 103 each having openings **103*a* for radiating acoustic waves are disposed, and a diaphragm 106 having a voice coil 102 is disposed therebetween, as shown in FIG. 8. Each magnetic plate 103 is magnetized so that its lines of magnetic force are parallel to the diaphragm 106. The voice coil 102 is fixed on the diaphragm 106** in a spiral shape.

Figure 9:
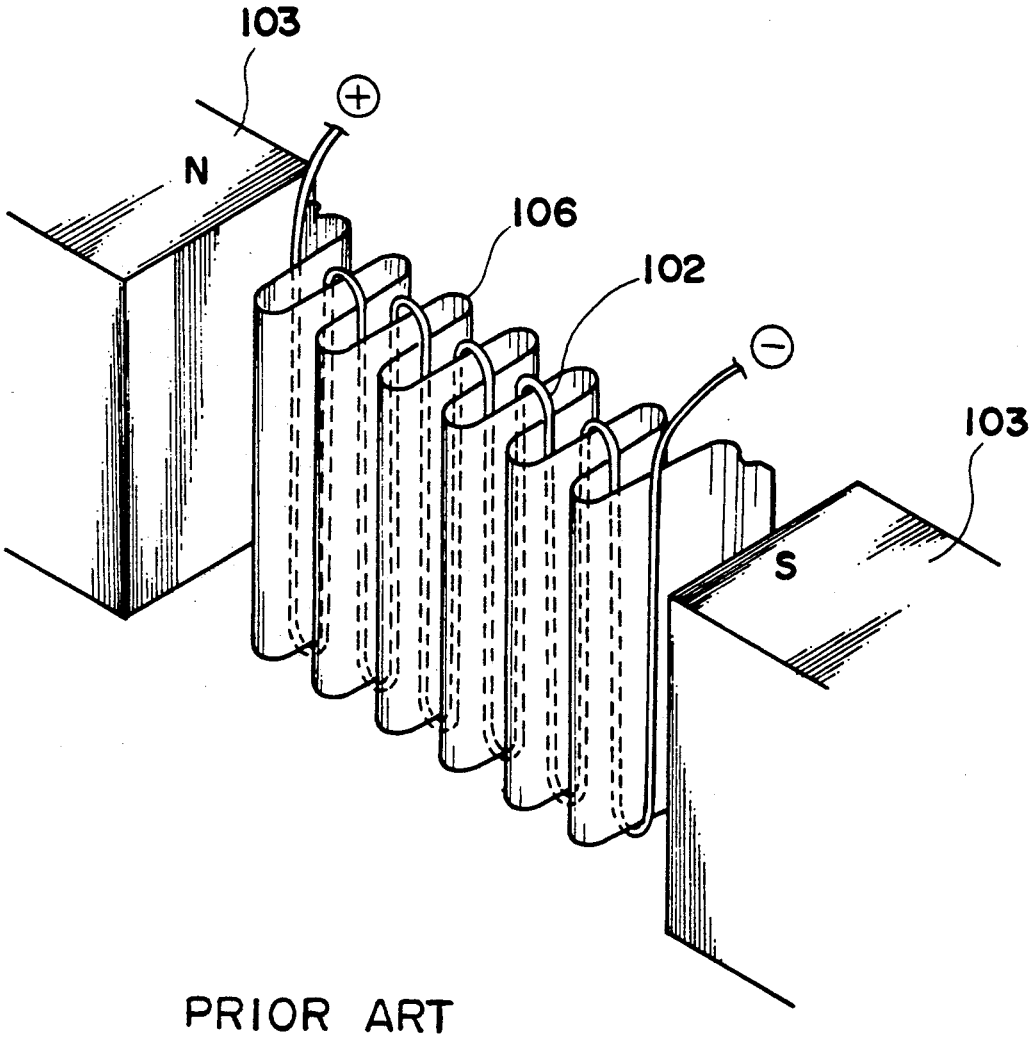
PRIOR ART FIG. 9

In a hile driver type dynamic speaker shown in FIG. 9, the voice coil 102 is also disposed on the diaphragm 106. More specifically, the diaphragm 106 is arranged in a bellows-like shape, and the voice coil 102 is fixed thereto in a zig-zag manner. With this speaker, drive current is flowed through the voice coil 102, so that the bellows of the diaphragm 106 is alternately expanded/-contracted, thus radiating an acoustic wave.

Figure 10:
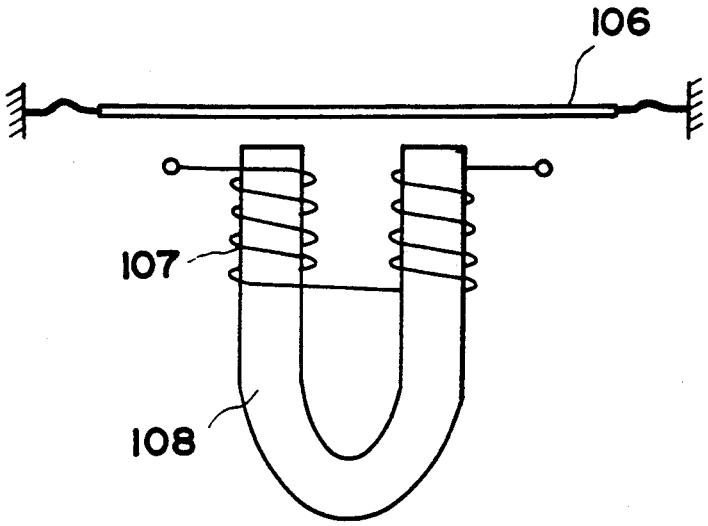
PRIOR ART FIG. 10
FIG. 10 is a view for explaining an example of an electromagnetic speaker.

An electromagnetic speaker as shown in FIG. 10 is known. As shown in FIG. 10, a diaphragm 106 arranged in a vibration free state includes a magnetic member, and an iron core 108 around which a coil 107 is wound is arranged near the diaphragm 106. In this speaker, a drive current is flowed through the coil 107, so that the diaphragm 106 is vibrated by the lines of magnetic force from the iron core 108, thus radiating an acoustic wave in the vertical direction in FIG. 10.

Figure 11:
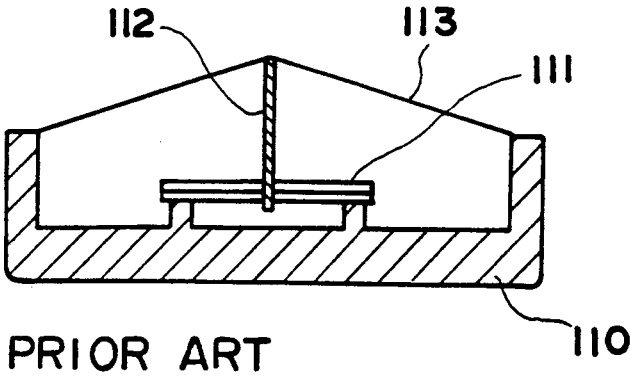
PRIOR ART FIG. 11
FIG. 11 is a sectional view for explaining an example of a piezoelectric speaker.

A piezoelectric speaker as shown in FIG. 11 is known. As shown in FIG. 11, two ends of a bimorph 111 which is vibrated by an electrostrictive effect are fixed to a support member 110, and a vibration rod 112 projects upright from the central portion of bimorph 111. The distal end of the vibration rod 112 abuts against substantially the central portion of a diaphragm 113 fixed to the support member 110. In this speaker, the bimorph 111 is bent by the electrostrictive effect, so that its central portion is vibrated vertically. The vibration of the bimorph 111 is transmitted to the diaphragm 113 through the vibration rod 112. Therefore, the diaphragm 113 is vibrated in accordance with a drive current so as to radiate an acoustic wave.

Figure 12A:
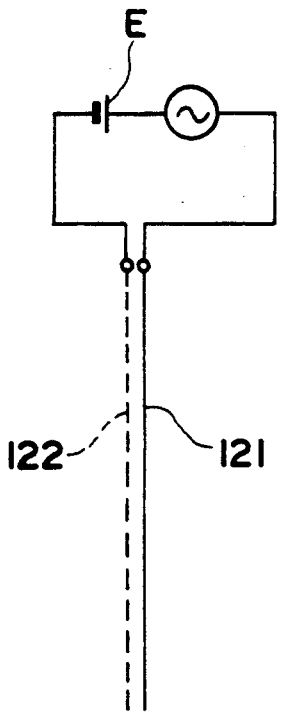
PRIOR ART FIG. 12A
FIGS. 12A and 12B are circuit diagrams for explaining examples of electrostatic speakers.
Figure 12B:
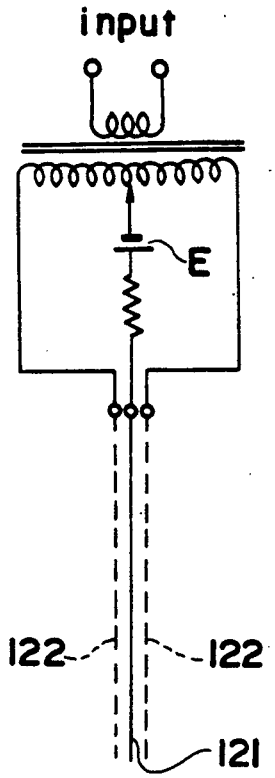
PRIOR ART FIG. 12B

Electrostatic speakers as shown in FIGS. 12A and 12B are known. The speaker shown in FIG. 12A is called a single type capacitor type speaker, and the speaker shown in FIG. 12B is called a push-pull type capacitor type speaker. In FIG. 12A, a diaphragm 121 is juxtaposed near a mesh electrode 122, and receives an input signal superposed on a bias voltage E. Therefore, the diaphragm 121 is vibrated by an electrostatic effect, thus radiating an acoustic wave. In FIG. 12B, the diaphragm 121 is sandwiched between two mesh electrodes 122. The operation principle is the same as that of FIG. 12A.

As indicated in FIGS. 13–19, there are various systems of effecting a motional feedback and of detecting a motional signal.

The fundamental or basic constitution of the motional feedback unit has already been explained with reference to FIG. 2, and it comes to be necessary to detect a motional signal corresponding to the movement of the diaphragm in order to carry out the motional feedback drive. As previously mentioned, the system of detecting the motional signal includes a system of detecting displacement, a system of detecting velocity or a system of detecting acceleration, and the detecting unit has a constitution by which a motional signal is detected in an electric circuit manner from the output of a vibrator driver or from the diaphragm of a vibrator.

Figure 13:
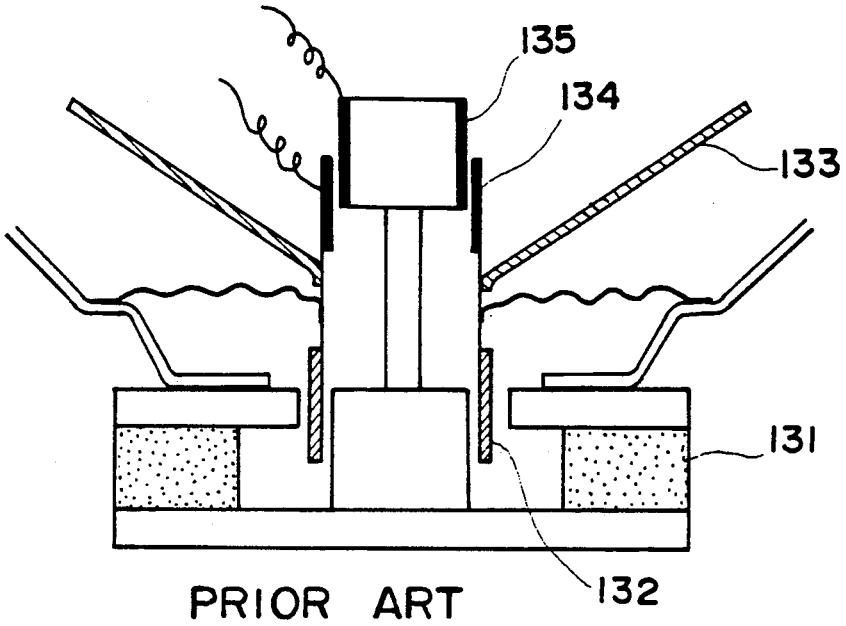
FIG. 13 is a sectional view showing a basic arrangement of a variable capacity type MFB speaker for detecting a deviation of a diaphragm.

The displacement detecting system is such that there is obtained a motional signal in an amount corresponding to the amplitude of a diaphragm, that is, corresponding to the integral output of the voltage across an equivalent motional impedance. The mechanical constitution of the displacement detecting system is exemplified by a capacity- variable MFB speaker as shown in FIG. 13. As shown, when a driving coil 132 inserted into the magnetic gap formed by a driving magnet 131 displaces, a cone 133 vibrates to radiate acoustic waves. A movable electrode 134 is connected to the driving coil 132, and a fixed electrode 135 is disposed near the movable electrode 134 and opposite thereto Accordingly, when the driving coil 132 displaces, the movable electrode 134 also displaces in the same amount as the coil 132 thereby to generate between the electrodes 134 and 135 an electrostatic capacity in proportion to the amount of displacement (amplitude) of the cone 133 which is a diaphragm, this capacity being detected as the motional signal.

Figure 14:
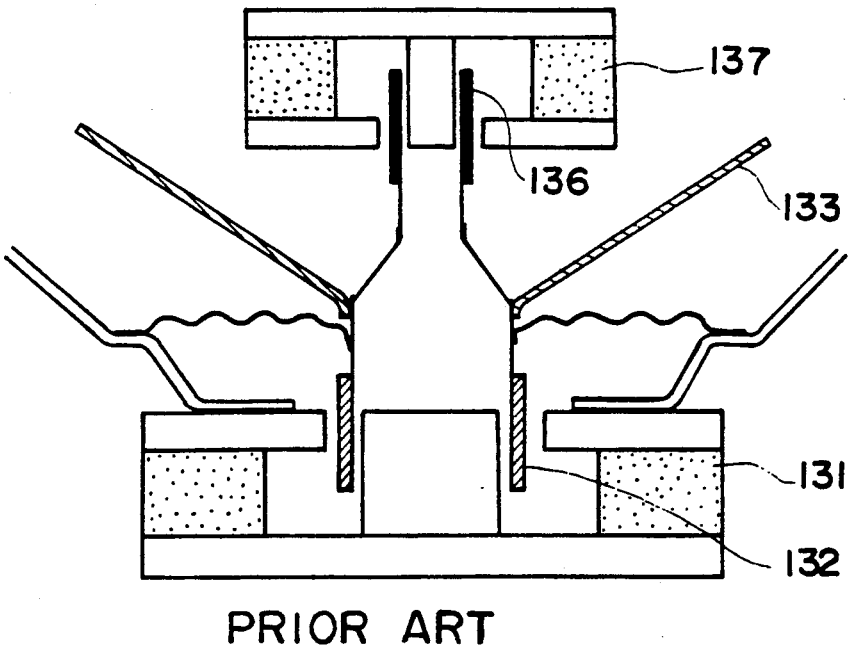
FIG. 14 is a sectional view showing a basic arrangement of a sensing coil type MFB speaker for detecting a velocity of a diaphragm.

The velocity detecting system is such that there is obtained the velocity of a diaphragm, that is a motional signal in an amount corresponding to the voltage across an equivalent motional impedance, and the mechanical constitution of said system is known as a detection coil type MFB speaker as shown in, for example, FIG. 14. As shown in this Figure, when the driving coil 132 inserted into a magnetic gap by a driving magnet 131 displaces, a cone 133 is vibrated to radiate acoustic waves. A detecting coil 136 is connected to the drive coil 132 and is inserted into a magnetic gap by a detecting magnet 137. Accordingly, when the driving coil 132 displaces, the detecting coil 136 also displaces at the same velocity whereby a voltage proportional to the velocity of the cone 133 (which is a diaphragm) is transmitted to the detecting coil 136 and is detected as a motional signal.

Figure 15:
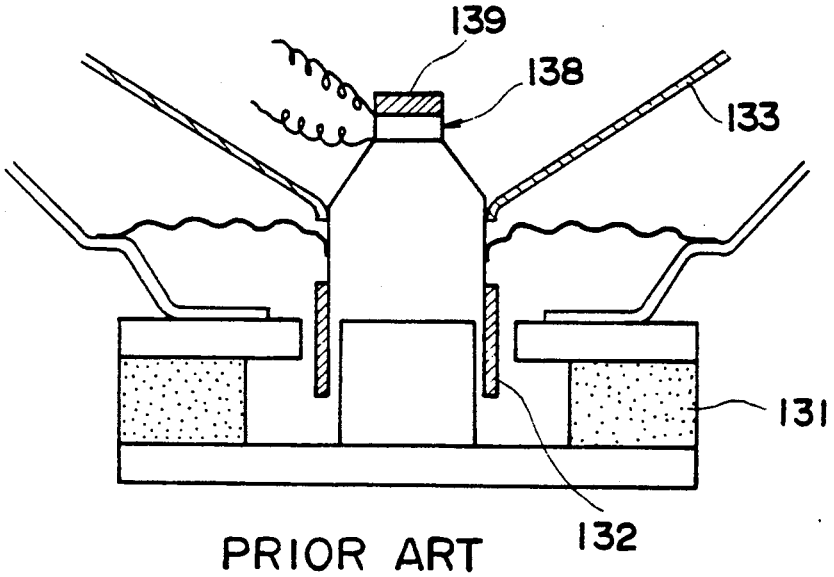
PRIOR ART F I G. 15
FIG. 15 is a sectional view showing a basic arrangement of a piezoelectric type MFB speaker for detecting a acceleration of a diaphragm.

The acceleration detecting system is such that there is obtained a motional signal in an amount corresponding to the acceleration of a diaphragm, that is, an amount corresponding to a voltage across an equivalent motional impedance, and the mechanical constitution of said system is illustrated by a piezo-electric MFB loudspeaker as shown in FIG. 15. In this Figure, the drive coil 132 is connected to a ceramic 138 capable of exhibiting piezo-electric effects, and this ceramic 138 is loaded with a weight 139. Thus, a pressure is applied to the ceramic 138 by the displacement of the drive coil 132 whereby a voltage proportional to the acceleration of the cone 133 is generated from the ceramic 138 and is detected as a motional signal. This acceleration detecting system is further illustrated by one which directly picks up the sounds from a speaker by the use of a sonic pressure detecting type microphone or the like.

The amplitude-corresponding, velocity-corresponding and acceleration-corresponding motional signals detected as mentioned above may be converted to one another by the use of a differential circuit or integral circuit. For example, an amplitude-corresponding signal may be differentiated to obtain a velocity-corresponding signal, and, further, the. velocity- corresponding signal may be differentiated to obtain an acceleration-corresponding signal. Conversely, one of said signals may be integrated to obtain another signal. Therefore, irrespective of the fact that which one of the three detecting systems is used, signals corresponding to amplitude, velocity and acceleration can be fed back singly or in suitable combination.

With respect to the feedback of such amplitude-, velocity- and acceleration-corresponding motional feedbacks based on the detection by said three kinds of detecting systems, frequency bands in which the effects of these motional feedbacks are respectively great will vary. Concretely speaking, when the amplitude-corresponding motional signal is fed back, a servo- effect is remarkably exhibited in a band lower than the value neighborhood corresponding to the lowest resonance frequency $f_o$; when the velocity-corresponding motional signal is fed back, a servo-effect is remarkably exhibited in the band of the value neighborhood corresponding to the lowest resonance frequency $f_o$; and when the acceleration corresponding motional signal is fed back, a servo-effect is remarkably exhibited in a region higher than the value neighborhood corresponding to the lowest resonance frequency $f_o$. For this reason, to drive Helmholtz resonator, it is preferred that the band in which the servo- effect is obtained is suitably matched with the band in which the resonator resonates.

It is seen from the above results that in a loudspeaker system, the internal impedance inherent in a vibrator can apparently be invalidated by combining said three types of motional signals. For example, the velocity detecting system using the coil is adopted in the detection of the motional signal, the velocity-corresponding motional signal detected is fed back as it is for the value neighborhood corresponding to the lowest resonance frequency $f_o$, the amplitude-corresponding motional signal obtained by electrically integrating a detected signal is fed back for the band lower than the value neighborhood corresponding to the lowest resonance frequency $f_o$, and the acceleration-corresponding motional signal obtained by electrically differentiating a detected signal is fed back for the frequency band higher than the value neighborhood corresponding to lowest frequency $f_o$, whereby the band in which the servo-effect is exhibited is widened to enable a large amount of feedback to be effected.

In this case, the region in which the servo-effect is exhibited can be widened in each of said three detecting systems by increasing the amount of negative feedback of the detected motional signal to the input side. In addition, in case of the acceleration detection, the phase rotation of the detecting output approaches 180° (never exceeding 180° ) in a super-bass (super-low frequency) region and the motional feedback becomes unstable as such and is apt to oscillate. In case of the velocity detection, however, the phase rotation is not higher than 90° and, therefore, a considerable amount of feedback can be effected. Thus, it is technically easy to obtain the effects of the present invention in a wide region by a combination of feedbacks of the amplitude-, velocity- and acceleration- corresponding motional signals as mentioned above.

Figure 16:
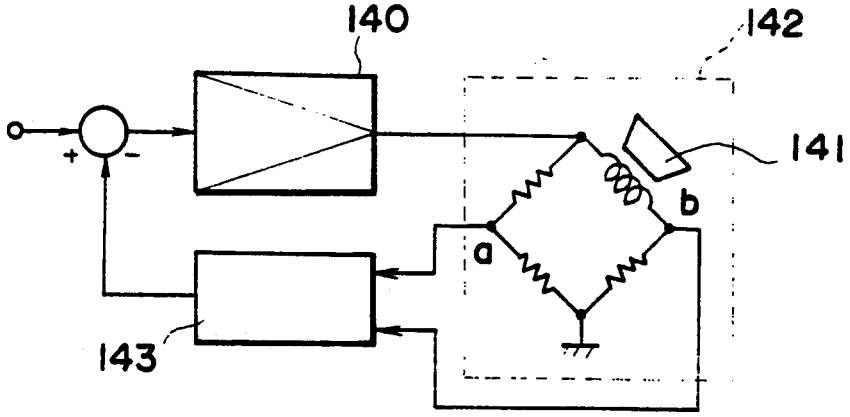
PRIOR ART F I G. 16
FIGS. 16 and 17 are each a diagram showing a motional feedback circuit using a bridge detection circuit.

Referring now to FIG. 16, there will be explained a first example of bridge-type motional feedback as a system which detects the motional signal by the electrically constituted detecting means and negatively feeds it back. As shown in the Figure, the output of an amplifier 140 is given to a loudspeaker 141. The equivalent motional impedance of the speaker 141 constitutes a bridge circuit 142 together with three resistance, and a voltage pressure corresponding to the velocity of a diaphragm designed to be given to a feedback circuit 143. The motional signal which has variously been converted by the feedback circuit 143, is negatively fed back to the input side of the amplifier 140. Further, in the present invention, the front face of the diaphragm of the speaker 141 constitutes a direct radiation portion for directly radiating acoustic waves to the outside, while the reverse face of the diaphragm constitutes a resonator drive portion and a Helmholtz resonator (not shown) is disposed therein.

In such a circuit, signals at motional detecting points a, b in the bridge circuit 142 are given to the feedback circuit 143, and back electromotive force generated by the movement of diaphragm of the speaker 141, that is the velocity component of the diaphragm, is detected by a motional detector (not shown) included in the feedback circuit 143. Then, this velocity- corresponding signal is negatively fed back as it is or after differential or integral operation thereof whereby is applied to the equivalent motional impedance of the speaker 141 a signal whose amount corresponds to a drive input, thereby enabling an ideal operation without excessive response. Further, the internal impedance inherent in the speaker 141 is apparently invalidated or reduced by said negative feedback of the motional signal, and, accordingly, the resonator comes to operate independently while being driven by the speaker 141 resulting in that the resonator may be in the compact form, but it enables the reproduction of super-bass.

The signals at the detecting points a, b include a distortion generated at the amplifier or a distortion generated due to the non-linearity of the speaker 141, but these distortions are reduced. The constitution and functions themselves of the bridge detecting circuit indicated in FIG. 16 were already known prior to the filing date of the present application and are disclosed in, for example, Japanese Patent Publications Nos. sho 54-1171 and sho 54-38889.

Figure 17:
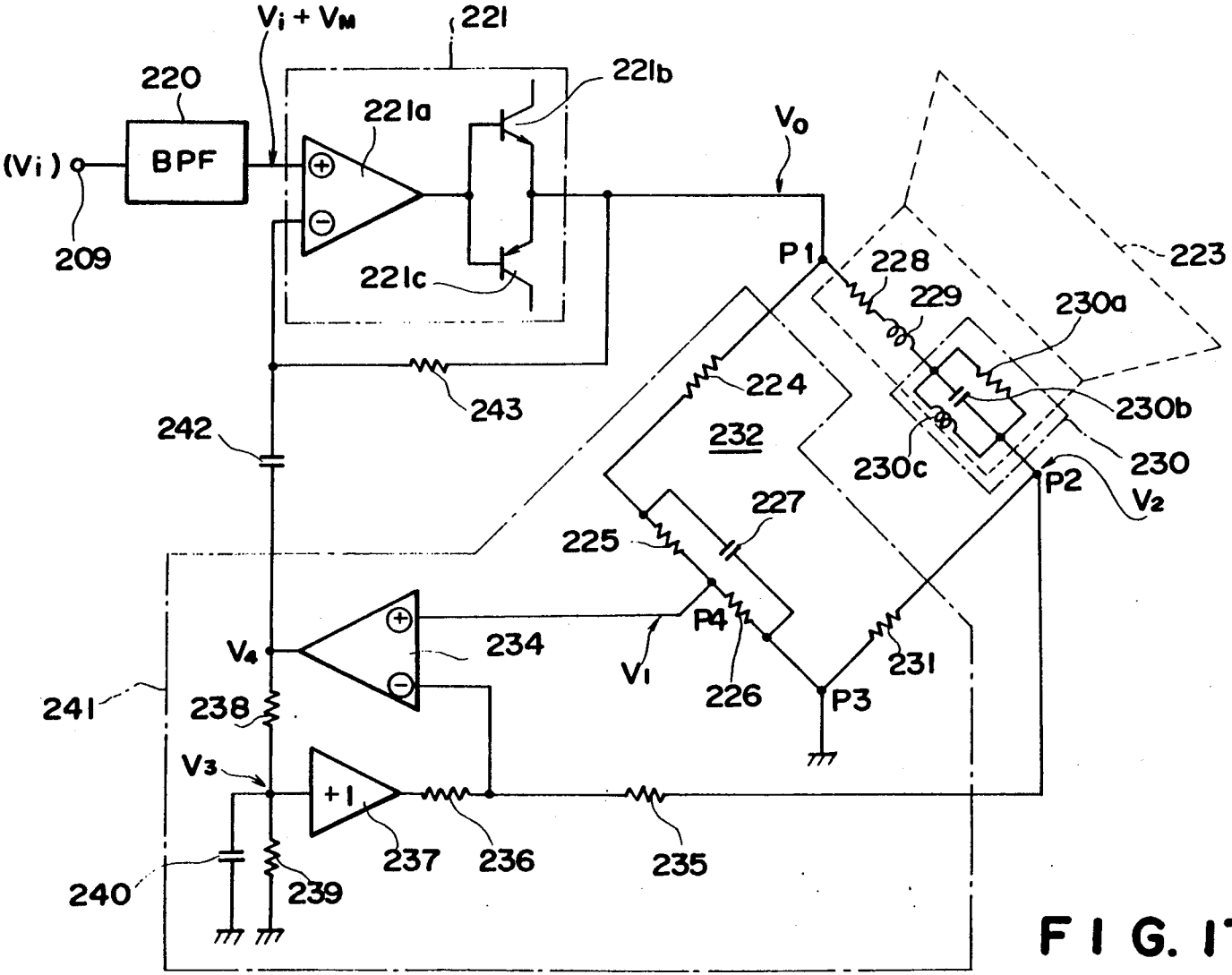
Figure 18:
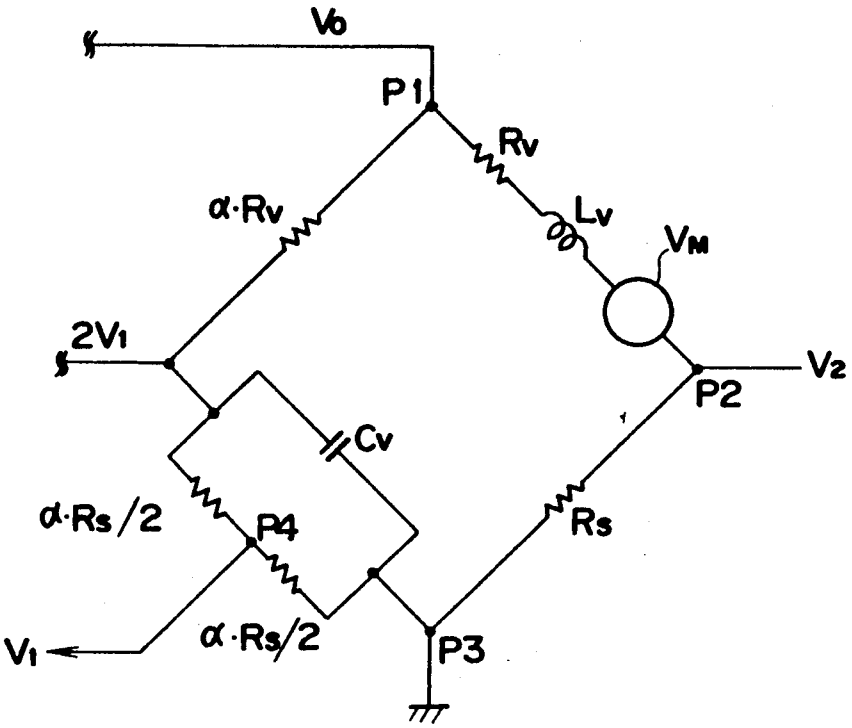

Referring now to FIGS. 17 to 19, there will be explained a second example of motional feedback using bridge detection.

FIG. 17 is a circuit concerned. In this Figure, a band pass filter (BPF) circuit 220 is composed of a variable resistor, capacitor, amplifier (none of them shown) and the like, and the circuit allows a signal $V_i$ to be inputted thereto from an input terminal 209 and outputs a signal $(V_i + V_M)$. The $V_M$ is a motional voltage which is applied to the equivalent motional impedance of an dynamic speaker 223. This circuit enables the voltage wave form of the input signal Vi to be accurately transmitted to between both the ends of the motional impedance of the speaker 223.

An amplifier unit 221 is composed of a voltage amplifier 221*a* having a large open-loop-gain, and a NPN type transistor 221*b* and PNP type transistor 221*c* which compose a power stage. The output terminal of the voltage amplifier 221*a* is connected to each of the base terminals of the transistors 221*b* and 221*c*. The emitter terminals of the transistors 221*b* and 221*c* are commonly connected thereby to constitute the output terminal of the amplifier unit 221. The output terminal of the amplifier unit 221 is connected to one terminal of the speaker 223, and one surface of the diaphragm of the speaker 223 serves as a direct radiation portion for radiating acoustic waves directly to the outside, while the other surface serves as a resonator driver portion. Along by this driver portion, a Helmholtz resonator (not shown) is provided.

This terminal of the speaker 223 is grounded through a resistor 224 (having a resistance of $\alpha \cdot R_v$), a resistor 225 (having a resistance of $\alpha \cdot R_s/2$) and a resistor 226 (having a resistance of $\alpha \cdot R_s/2$) in series. In this case, a capacitor 227 (having a capacitance of $C_v$) is connected as a component corresponding to an inductance $L_v$ in the internal impedance of speaker 223, in parallel to a series circuit consisting of the resistors 225 and 226. In addition, the other terminal of the speaker 223 is grounded through a resistor 231 (having a resistance of $R_s$). The speaker 223 can be electrically represented by an equivalent circuit which is constituted by a series circuit consisting of a voice coil internal resistor 228 (having a resistance of $R_v$), a voice coil internal inductance 229 (having an inductance of $L_v$) and an equivalent circuit 230 of a mechanical vibration system of the speaker 223. This equivalent circuit 230, i.e., an equivalent motional impedance, can be represented as a parallel circuit consisting of an equivalent resistor 230*a*, an equivalent capacitor 230*b* and an equivalent inductance 230*c*. The equivalent circuit of a Helmholtz resonance system is constituted by a series resonance circuit (shown in FIG. 1B) connected in parallel to this equivalent circuit 230 of vibration system and is explained without reference to a figure for brevity.

The above-mentioned speaker 223, resistors 224 to 226 and 231, and capacitor 227 together constitute a bridge circuit 232 for detecting the motional voltage $V_M$. The combined resistance of the resistors 224 to 226 within the bridge circuit 232, represented by $(\alpha \cdot R_v + \alpha \cdot R_s/2 + \alpha \cdot R_s/2)$, is set to be sufficiently larger than that $(R_v + R_s)$ of the resistors 228 and 231, and the resistance $R_s$ of resistor 231 is set to be sufficiently smaller than the resistance $R_v$ of the resistor 228. Meanwhile, the resistors 224, 225, 226 and 231 are set to have relationship with the speaker 223 as indicated in the following equation:

$$(\alpha \cdot R_v)/(\alpha \cdot R_s) = R_v/R_s \quad (5)$$

By determining the resistance of resistors as described above, it becomes possible to accurately detect the motional voltage $V_M$ between a connection point P4 where the resistors 225 and 226 are connected together and another connection point P2 where the resistor 231 and the other terminal of the speaker 223 are connected together as will later be described in detail.

The point P4 where the resistors 225 and 226 are connected together is connected to the non-inverting input terminal of an amplifier 234, and a point P2 where the speaker 223 and the resistor 231 are connected together is connected through a resistor 235 (having a resistance of r) to the inverting input terminal of the amplifier 234 and is also connected to one terminal of a resistor 236 (having a resistance of r). The other terminal of the resistor 236 is connected to the output terminal of an amplifier 237. The amplifier 237 is designed to have a voltage gain "+1". The input terminal of the amplifier 237 is connected to the output terminal of the amplifier 234 through a resistor 238 (having a resistance of $\beta \cdot R_v$) and is grounded through a parallel circuit consisting of a resistor 239 (having a resistance of $\beta \cdot R_s$) and a capacitor 240 (having a capacitance of $C_v' = L_v/(\beta \cdot R_s \sqrt{R_v})$) The bridge circuit 232, the amplifiers 234 and 237, the resistors 235, 236, 238 and 239, and the capacitor 240 together constitute a bridge amplifier unit 241. This bridge amplifier unit 241 corresponds to a detecting means for detecting motional voltage applied to the equivalent motional impedance and outputting a motional signal.

The output terminal of the amplifier 234 is connected to one of the terminals of a capacitor 242 (having a capacitance of $C_f$). The other terminal of the capacitor 242 is connected to one of the terminals of a resistor 243 (having a resistance of $R_f$) and also connected to the inverting input terminal of the amplifier 221*a* within the amplifier unit 221. The other terminal of the resistor 243 is connected to the output terminal of the amplifier unit 221. The capacitor 242 is used for blocking direct current, and the resistor 243 is used as a feedback resistor.

Next, a description will be given with respect to a principle of detecting the motional voltage $V_M$ by use of the bridge amplifier unit 241.

Figures 19A, 19B:
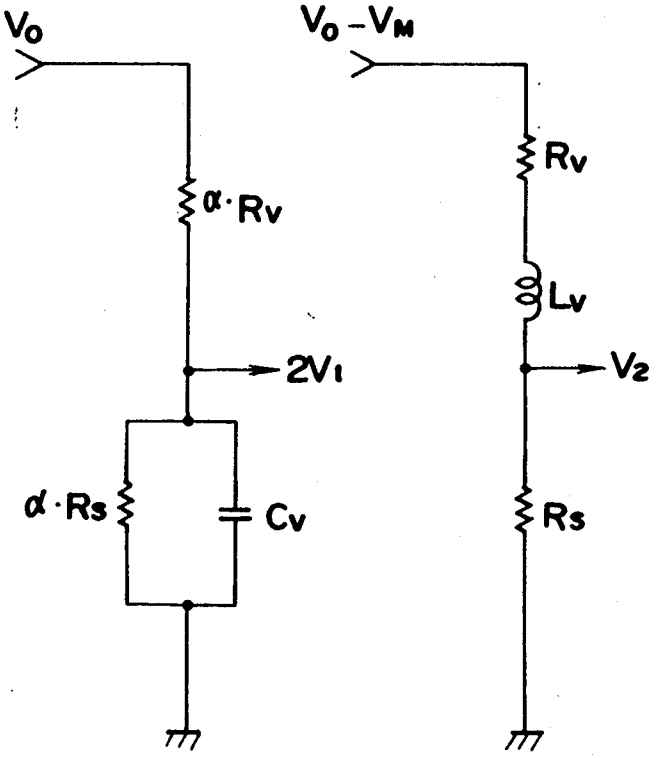
FIGS. 18 and 19A and 19B are electric equivalent circuit diagrams of the bridge circuit shown in FIG. 17.

FIG. 18 shows a circuit diagram of the detecting bridge circuit 232 shown in FIG. 17, in which each of electrical elements is denoted by a value of resistance, inductance or capacitance. FIG. 19A is a diagram of one half of the circuit of FIG. 18, and FIG. 19B a diagram of the other half thereof. First, in the bridge circuit 232 shown in FIG. 18, the relation between voltages $V_0$ to $V_4$ can be represented by the following formula (6). In this formula, $V_0$ denotes a voltage supplied from the amplifier portion 221, $V_1$ denotes a voltage supplied to the non-inverting input terminal of the amplifier 234, $V_2$ denotes a voltage at the connection point P2, $V_3$ denotes a voltage at the input terminal of the amplifier 237 and $V_4$ denotes a voltage at the output terminal of the amplifier 234.

$$\begin{aligned} V_3 &= V_4 \cdot (\beta \cdot R_s//C_v')/(\beta \cdot R_s//C_v' + \beta \cdot R_v) \\ &= V_4 \cdot R_s/(R_s + R_v + j\omega L_v) \end{aligned} \quad (6)$$

(wherein $C_v' = L_v/(\beta \cdot R_s \cdot R_v)$)

In addition, since the following formula:

$$V_1 = (r \cdot V_2 + r \cdot V_3)/(r \cdot r) = (V_2 + V_3)/2$$

is established based on the characteristic of operational amplifier with feedback, the following formula (7) can be obtained.

$$V_3 = 2 \cdot V_1 = V_2 \quad (7)$$

Next, by referring to FIG. 19, the voltages V1 and V2 can be obtained respectively from the following formulae (8) and (9).

$$\begin{aligned} 2 \cdot V_1 &= V_0 \cdot (\alpha \cdot R_s//C_v)/(\alpha \cdot R_s//C_v + \alpha \cdot R_v) \\ &= V_0 \cdot R_s//(R_s + R_v + j\omega L_v) \end{aligned} \quad (8)$$

(wherein $C_v = L_v/\alpha \cdot R_s \cdot R_v$))

$$V_2 = (V_0 - V_M) \cdot R_s/(R_s + R_v + j\omega L_v) \quad (9)$$

When the above mentioned formulae (8) and (9) are put in the formula (7), the following formula (10) can be obtained.

$$V_3 = V_M \cdot R_s / (R_s + R_v + j\omega L_v) \quad (10)$$

Thus, the following formula (11) can be obtained from the formula (6) and (10).

$$V_4 = V_M \quad (11)$$

Accordingly, the motional voltage $V_M$ of the speaker 223 can be obtained from the output of the amplifier 234 with accuracy.

Next, description will be given with respect to the operation of the circuit of FIG. 17.

First, the input signal $V_i$ applied to the signal input terminal 209 is supplied to the BPF circuit 220 whereby the signal level of predetermined frequency components of the input signal $V_i$ is raised. More specifically, the internal impedance inherent in the speaker 223 is apparently invalidated due to the motional feedback drive being effected, resulting in that the speaker 223 behaves in such a manner as $Q \approx$ thereby to lower the sound pressure characteristic at the value neighborhood corresponding to the lowest resonance frequency $f_o$; to compensate for said lowering, the signal level in the pertinent frequency band is raised In other words, a frequency characteristic curve of the signal $(V_i + V_M)$ outputted from the BPF circuit 220 is in a form approximately similar to the impedance characteristics of the speaker 223. This signal $(V_i + V_M)$ is supplied to the non-inverting input terminal of the amplifier 221*a* within the amplifier unit 221 wherein the signal is amplified. Then, the amplified signal is supplied to the speaker 223, whereby the speaker 223 will be driven to exhibit approximately flat sound pressure characteristics.

At this time, the motional voltage $V_M$ is produced between both the terminals of the equivalent circuit 230 of the speaker 223. The motional voltage $V_M$ is detected by the bridge amplifier unit 241, and the detected motional voltage $V_M$ is supplied to the inverting input terminal of the amplifier 221a via the capacitor 242. Since a capacitor 227 corresponding to the internal inductance inherent in the speaker 223 is provided in the detection bridge, the motional voltage is far more correctly detected by this detection bridge than by a conventional one, whereby the motional voltage $V_M$ is correctly fed back in an extremely large amount of feedback to the amplifier unit 221.

Since in this manner the motional voltage $V_M$ is made to be negatively fed back in an extremely large amount to the amplifier unit 221, the internal impedance ($R_v$, $L_v$) is almost completely invalidated whereby the speaker 223 faithfully responds to drive inputs and radiate acoustic waves entirely without including distortions caused by the transient response of the vibration system. Further, since the drive input level is additionally controlled, the same flat sound pressure- frequency characteristics as conventional can finally be realized and, further, said characteristics can be extended to a lower region depending on the contents of said drive input level control.

In addition to this, the vibration system of the speaker 223 does substantially not serve as a resonance system, and the diaphragm of the speaker 223 becomes equivalent to the wall surface of a Helmholtz resonator (not shown) resulting in that energy is supplied to this resonance system independently of the vibration system of the speaker 223. In addition, since the internal impedance is apparently invalidated, the Q value of the Helmholtz resonator will not decrease at all even if the speaker 223 is provided along by the Helmholtz resonator, resulting in that the acoustic wave radiation capability of said resonator is sufficiently enhanced.

Methods for detecting motional signals are not limited to those mentioned and various modified one are useful.

First of all, a method for optical detection comprises, for example, fixing a shutter to the diaphragm of a speaker and providing a pair of a luminous element and a photoreceptor element in such a manner that these elements sandwich the shutter in therebetween. This enables the shutter to move in accordance with the movement of the diaphragm thereby to vary the amount of light received of the photoreceptor element, thus obtaining motional signals corresponding to the amplitude of the diaphragm, etc. Further, in a case where the diaphragm is provided with a mirror, the light from the luminous element is impinged upon the mirror and then the reflected light is received, the path of light changes in accordance with the movement of the diaphragm thereby rendering it possible to detect motional signals. Such detections are known from Japanese Utility Model Publications Nos. sho 42-5561 and sho 42- 15110 as well as from Japanese Utility Model Publication No. sho 43-12619 in which the use of modulation by slits is disclosed and Japanese Patent Publication No. sho 54-111327 in which the use of photofibers is disclosed.

Detection using semiconductors can be carried out, for example, by inserting a magnetism-sensitive semiconductor element and obtaining motional signals corresponding to the velocity of a diaphragm (Japanese Utility Model Publication No. sho 44-28472) or by providing a hall element in front of the pole piece of a speaker and obtaining motional signals corresponding to the velocity of a diaphragm (Japanese Pat. Appln. Laid-Open No. sho 49-102324).

Detection using piezo-electric effects can be carried out, for example, by providing a piezo-electric element in front of the cone paper of a cone speaker thereby obtaining motional signals corresponding to the acceleration of the cone paper (Japanese Utility Model Publication No. sho 41-20247), this being able to lessening effects on the cone paper.

Further, detection of the amplitude of a diaphragm is carried out by, for example, providing a bobbin movable electrode between an internal fixed electrode and an external fixed electrode to detect motional signals (Japanese Patent Publication No. sho 54-36486) this enabling the motional signals to be properly detected even if the movable electrode is inclined.

On the other hand, detection of motional signals by the use of electrical constitution is achieved by carrying out bridge detection by using a differential amplifying circuit (Japanese Utility Model Publication No. sho 44-9634) or by using a center-tapped output transformer as a component element of a bridge circuit (Japanese Utility Model Publication No. sho 43-2502).

Figure 20:
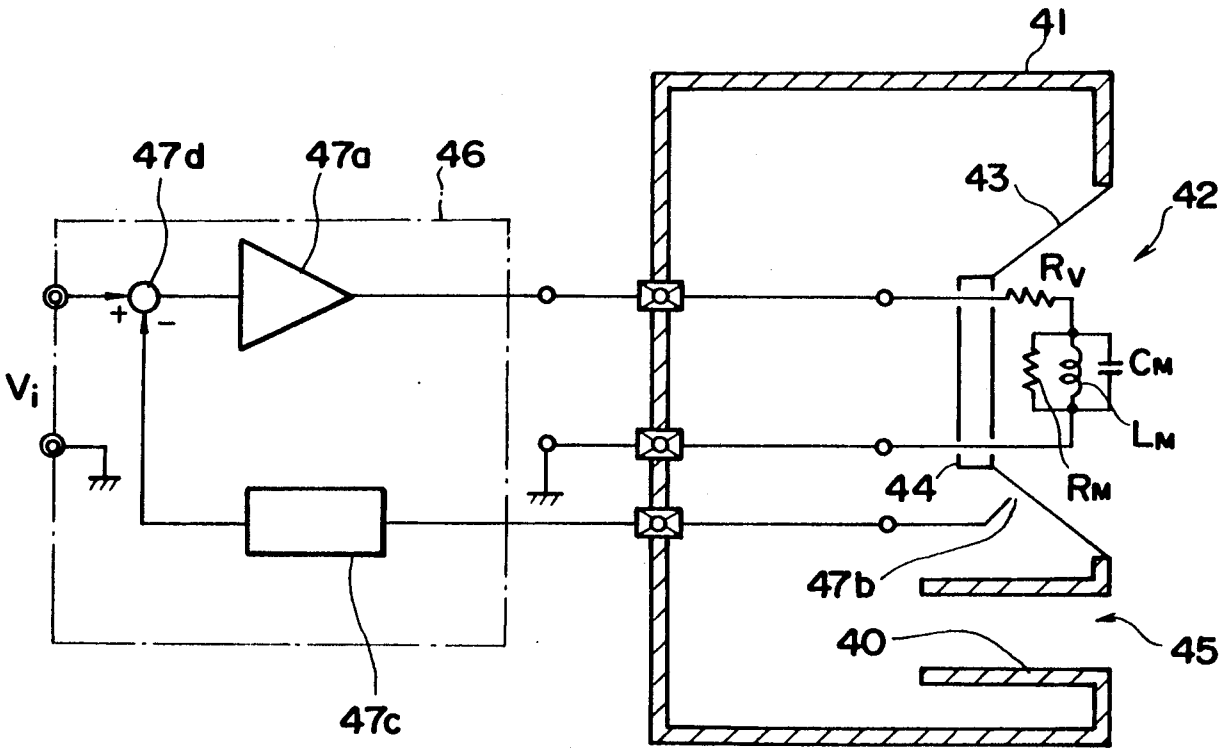
FIG. 20 is a diagram showing a concrete example of the first embodiment.

FIG. 20 is a diagram of arrangement of a concrete example of the first embodiment wherein the present invention is applied to a rectangular-prism cabinet. As shown in the Figure, a hole is formed in the front surface of a rectangular-prism cabinet 41, and a dynamic direct radiator speaker 42 is mounted therein. The speaker 42 is constituted by a conical diaphragm 43, and a dynamic transducer 44 arranged near the top of the diaphragm 43. An opening port 45 and a duct 40 are formed below the speaker 42 in the cabinet 41, and constitute a virtual woofer characterizing the present invention. A driver circuit 46 has a driver unit 47a having a large-open-loop gain, a detecting unit 47b for detecting the motional voltage applied to the equivalent motional impedance of the dynamic transducer 44, a feedback unit 47c for effecting a predetermined conversion on the output of the detecting unit 47b, and a subtracter 47d for negatively feeding back the motional signal outputted from the feedback unit 47c. The dynamic transducer 44 is driven by the output of the driver circuit 46.

The dynamic transducer 44 has a voice coil DC resistance $R_v$ as an inherent internal impedance, which can be apparently invalidated by the feedback driving of the driver circuit 46. Reference symbols $R_M$, $L_M$ and $C_M$ denote motional impedances obtained when the speaker 42 are electrically equivalently expressed. If the volume of the cabinet 41 is represented by V, the sectional area of the opening port 45 is represented by S, and the neck length of the duct 40 is represented by , as in equation (1) described above, a resonance frequency $f_{op}$ is given by:

$$f_{op}=c(S/lV)^{1/2}/2\pi$$

Figure 21:
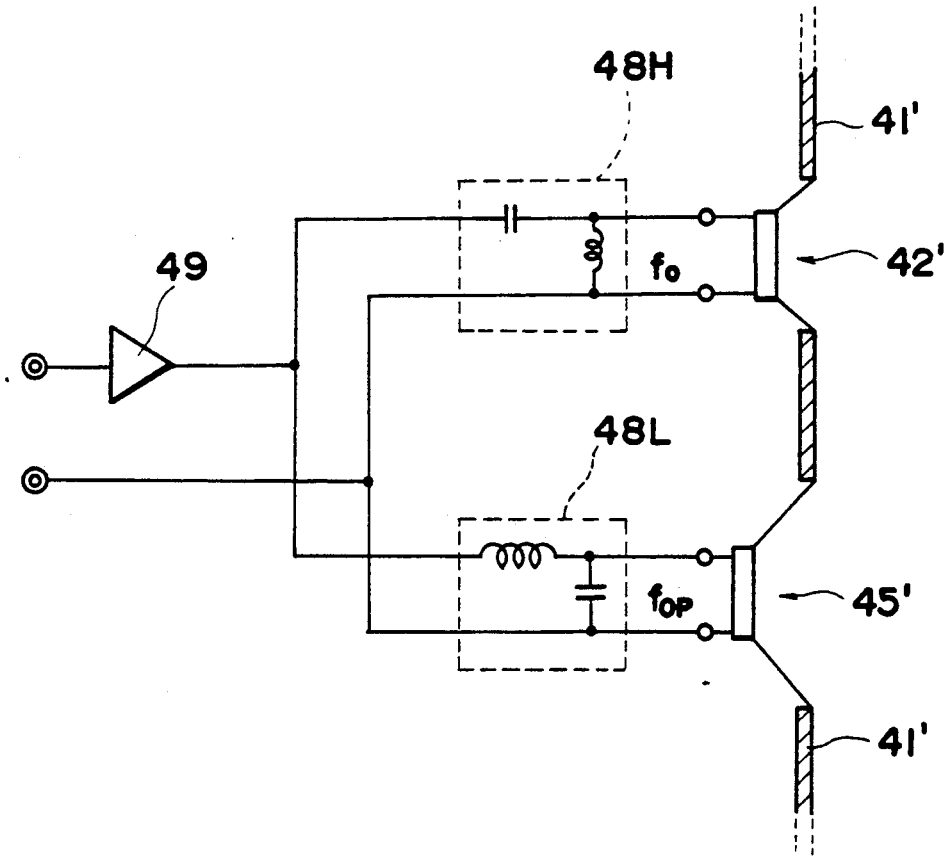
FIG. 21 is a diagram for explaining an equivalent operation of the apparatus shown in FIG. 20.

The arrangement of the equivalent operation of the example shown in FIG. 20 is as shown in FIG. 21. More specifically, a middle/high range speaker 42' formed by the speaker 42 and a virtual woofer 45' equivalently formed by the opening port 45 are equivalent to a state wherein they are mounted on a closed cabinet 41' having an infinite volume. The speaker 42' is connected to a conventional amplifier 49 (which is not subjected to active servo drive) through an equivalently formed high-pass filter (HPF) 48H. The woofer 45' is connected to the amplifier 49 through an equivalently formed low-pass filter (LPF) 48L. (Note that the HPF 48H and LPF 48L are expressed as secondary HPF and LPF, respectively, for the sake of emphasizing a similarity to a conventional network circuit.) The low frequency reproduction characteristic of the middle/high range speaker 42' is determined by the amount of negative feedback and kind of motional signal. Anyhow, since the internal impedance inherent in the middle/-high range speaker 42' apparently approximates zero, the speaker 42' becomes an element faithfully responsive to drive input. The characteristics of the speaker 42' are not influenced at all by the design specifications of the virtual woofer 45'. The resonance frequency $f_{op}$ of the woofer 45' may be set by only dimensions of the opening port 45 and the duct 40, and the resonance Q value of the woofer 45' can be desirably controlled at a time.

As can be apparent from the above description, according to the example shown in FIGS. 20 and 21, the virtual woofer is equivalently formed by the opening port 45 and the duct 40. Since this arrangement is equivalent to a state wherein the speakers are mounted on a closed cabinet having an infinite volume, extremely excellent bass reproduction characteristics can be realized. The specifications of the speaker unit and the cabinet can be desirably designed without restricting each other, and the system can be rendered compact as compared with any conventional speaker systems having equivalent characteristics.

According to the first embodiment of this invention, as shown in FIG. 21, since the HPF 48H and the LPF 48L are equivalently formed, the arrangement of the driver circuit can be simplified. For example, in a conventional two-way speaker system, HPF and LPF must be connected to inputs of a high range speaker (tweeter) and a woofer, respectively. Since these filters must have capacitances and inductances, the cost of the driver tends to be increased, and the volume of the filters occupied in the driver circuit tends to be also increased. In addition, their designs must be separately performed. In this invention, since these filters are equivalently formed, these prior art problems can be solved.

Sound pressure-frequency characteristics of the vibrator and the resonator as a whole can be arbitrarily set by increasing/decreasing an input signal level to an amplifier. Since both the vibrator and the resonator have sufficient acoustic radiation powers, the input signal level need only be adjusted, so that the sound pressure-frequency characteristics of the overall apparatus can be easily realized by wide-range uniform reproduction. In the circuit shown in FIG. 17, such adjusting is realized e.g. by the BPF circuit 220.

The present inventor obtained the following results upon comparison between the effect of the first embodiment of this invention and the effect of a bass-reflex type speaker system according to standard setting.

In an acoustic apparatus according to the present invention, the volume V of the cavity of the Helmholtz resonator was 6 liters, the inner diameter of the opening port was 3.3 cm, and its neck length was 25 cm. When a motional feedback operation was performed with dynamic con speaker, bass reproduction to $f_{op}=41$ Hz could be achieved. In contrast to this, in a bass-reflex type speaker system according to standard setting, bass reproduction to $f_{op}=41$ Hz was barely achieved when a dynamic cone speaker having $f_o=50$ Hz, $Q=0.5$ and a diameter $=20$ cm, and a cabinet having a volume of 176 liters are used. Therefore, it was found that the volume of the cabinet could be reduced to about 1/30 at an identical bass reproduction level according to the present invention.

EFFECT OF THE FIRST ASPECT OF THIS INVENTION

As has been described above in detail, according to the present invention, due to operation of a motional feedback means included in a vibrator drive means, the drive condition of the vibrator drive means is brought under follow-up control so that a signal in an amount corresponding to drive input is always correctly transmitted to an equivalent motional impedance side of a vibrator, whereby an internal impedance inherent in the vibrator can be apparently reduced or invalidated. For this reason, the vibrator becomes an element responsive to only an electrical drive signal input, and performs an ideal operation without causing a transient response at all. In addition, the resonance system of the vibrator is essentially no longer a resonance system, and the diaphragm of the vibrator becomes equivalent to only the wall surface of a resonator. Therefore, although the resonator is driven by the vibrator, it becomes an element which receives a drive energy independently of the vibrator. Since the resonator is free from the bad influence of the internal impedance inherent in the vibrator, the resonance Q value of the resonator is not lost at all, and its acoustic radiation power becomes strong. As a result, if the resonance Q value of the resonator is decreased due to some other factors, the resonator can have a sufficient margin.

In addition, since the apparent reduction or invalidation of the internal impedance inherent in the vibrator is basically realized by negative feedback, so-called excessive cancellation cannot be caused, and oscillation and the like are unlikely to be caused.

The bass reproduction characteristics of the vibrator do not depend on the volume of the resonator, and the resonance frequency of the resonator can be set only by an equivalent mass of a resonance radiation unit. The volume of the resonator is not an element for controlling bass reproduction characteristics of the resonator itself. As a result, bass reproduction characteristics of the apparatus can be set regardless of the volume of the apparatus. Thus, a compact acoustic apparatus capable of bass reproduction can be easily realized.

As shown in the mechanically or electrically equivalent circuit, since the resonance system by the vibrator and the resonance system by the resonator can be controlled independently (preferably, perfectly independently), the mutual dependency condition therebetween on design can be reduced (preferably, removed). Thus, an arbitrary band design can be readily achieved without any problem.

The acoustic apparatus of the present invention can be widely applied to sound sources of electronic or electric musical instruments, and the like as well as audio speaker systems.

Figure 22A:
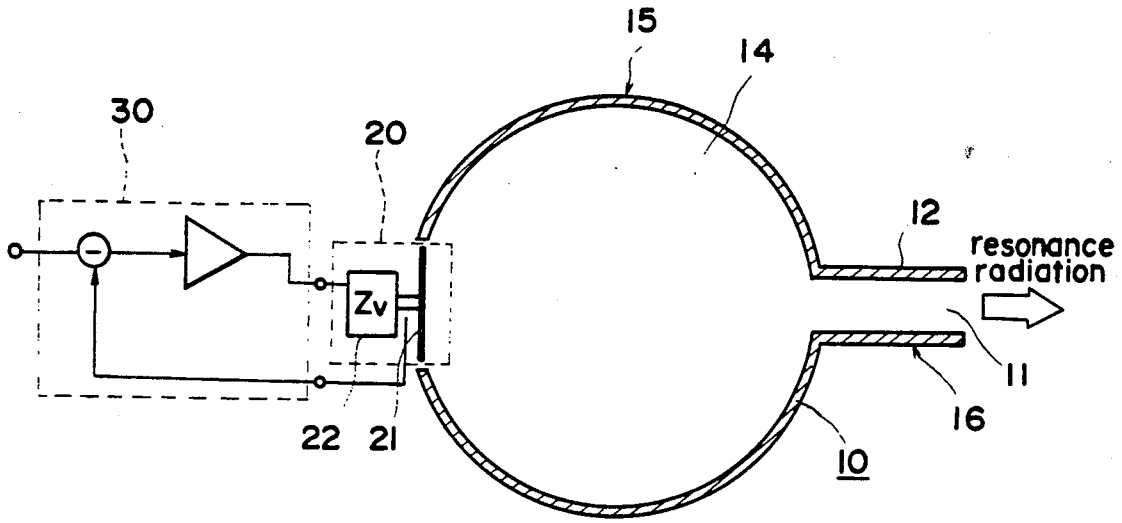
FIGS. 22A and 22B are diagrams for explaining a basic arrangement of a second embodiment of the present invention.
Figure 22B:
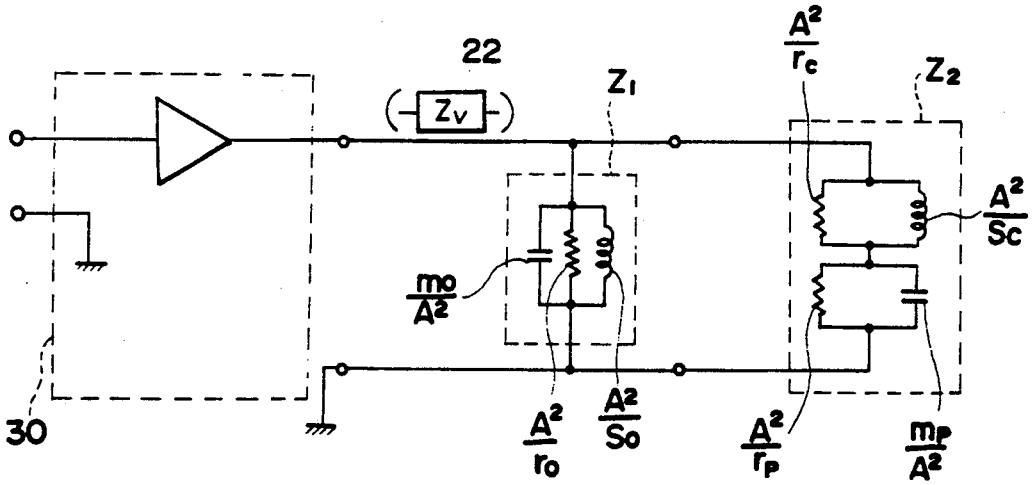

FIGS. 22A and 22B show a basic arrangement of a second embodiment of the present invention. As shown in FIG. 22A, in this embodiment, a Helmholtz resonator 10 having an opening port 11 and a neck 12 serving as a resonance radiation unit is used. In the Helmholtz resonator 10, a resonance phenomenon of air is caused by a closed cavity (hollow drum) 14 formed in a body portion 15 and a short tube or duct 16 constituted by the opening port 11 and the neck 12. The resonance frequency $f_{op}$ is given by equation (1) as described above.

$$f_{op}=c(S/lV)^{\frac{1}{2}}/2\pi$$

where c: velocity of sound

S: sectional area of duct 16 l: length of neck 12 of duct 16

V: volume of cavity 14

In the acoustic apparatus of this embodiment, a vibrator 20 constituted by a diaphragm 21 and a transducer 22 is attached to the body portion 15 of the resonator 10. The transducer 22 is connected to a vibrator driver 30, which comprises a motional feedback (MFB) unit for detecting, by using any appropriate method, motional signal corresponding to movement of the diaphragm 21 and negatively feeding back the signal to input side.

The constitution of the acoustic apparatus indicated in FIG. 22A is quite the same as that indicated in FIG. 1A except that the former is lacking in a portion corresponding to the direct radiation portion of the diaphragm 21. In this embodiment, although not particularly shown, said portion corresponding to the direct radiation portion constitutes a second resonance driver portion like the back face of the diaphragm of the speaker 83 of the conventional acoustic apparatus of FIG. 34 or is tightly closed by a cabinet like the back face of the diaphragm of the speaker 86' of the conventional apparatus of FIG. 36.

FIG. 22B shows the electric equivalent circuit of the acoustic apparatus of FIG. 22A. The circuit is the same as that of FIG. 1B.

The operation of the acoustic apparatus with the arrangement shown in FIG. 22A will be briefly described below.

When a drive signal is supplied from the vibrator driver 30 having a motional feedback function to the transducer 22 of the vibrator 20, the transducer 22 electro-mechanical converts the drive signal so as to reciprocally drive the diaphragm 21 forward and backward (in the right and left directions in the Figure). Since the vibrator driver 30 has a motional feedback unit, if the amount of negative feedback is extremely large, the condition of driving the vibrator driver 30 is brought under follow-up control so that a signal in an amount corresponding to the drive input is always correctly transmitted as the terminal voltage across said equivalent motional impedance, the differential voltage or integral voltage of said terminal voltage. In other words, motional voltages, etc., applied to the equivalent motional impedance are controlled so that they correspond to the drive input in a relation of 1:1. Accordingly, the vibrator driver 30 is apparently become equivalent to subjecting the equivalent motional impedance itself of the vibrator 20 directly to linear, integral or differential driving, and the internal impedance inherent in the transducer 22 is apparently invalidated. Therefore, the transducer 22 drives the diaphragm 21 faithfully in response to the drive signal from the vibrator driver 30, and independently supplies a drive energy to the Helmholtz resonator 10. In this case, the front surface side (the right surface side in the Figure) of the diaphragm 21 serves as a resonance driver portion for driving the Helmholtz resonator 10, and receives a reaction from air in the cavity 14 of the Helmholtz resonator 10. And then, the vibrator driver 30 drives the vibrator 20 so as to cancel the reaction. This is because the internal impedance $Z_v$ inherent in the transducer 22 of the vibrator 20 is equivalently invalidated. Hence, the diaphragm 21 becomes an equivalent wall of the Helmholtz resonator 10, and the resonance Q value ideally becomes infinite.

Figure 23:
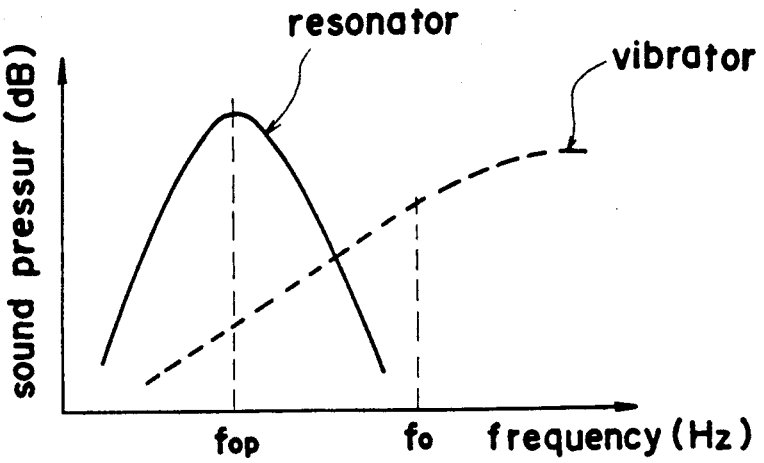
FIG. 23 is a graph showing sound pressure-frequency characteristics of the embodiment shown in FIGS. 22A and 22B.

For this reason, air in the Helmholtz resonator 10 is resonated by the operation of the vibrator 21, so that, as indicated by an arrow in FIG. 22A, an acoustic wave having a sufficient sound pressure is radiated from the resonance radiation unit. Further, by adjusting an air equivalent mass in the duct 16 of the Helmholtz resonator 10, the resonance frequency $f_{op}$ is set in a predetermined frequency range, and by adjusting the equivalent resistance of the duct 16, the resonance Q value is set to be an appropriate level, so that a sound pressure of an appropriate level can be obtained from the opening port 11. By these adjustments, sound pressure-frequency characteristics shown in, e.g., FIG. 23 can be obtained. Note that a dotted characteristic curve in FIG. 23 represents an example of frequency characteristics of the vibrator 20 itself.

Figure 24:
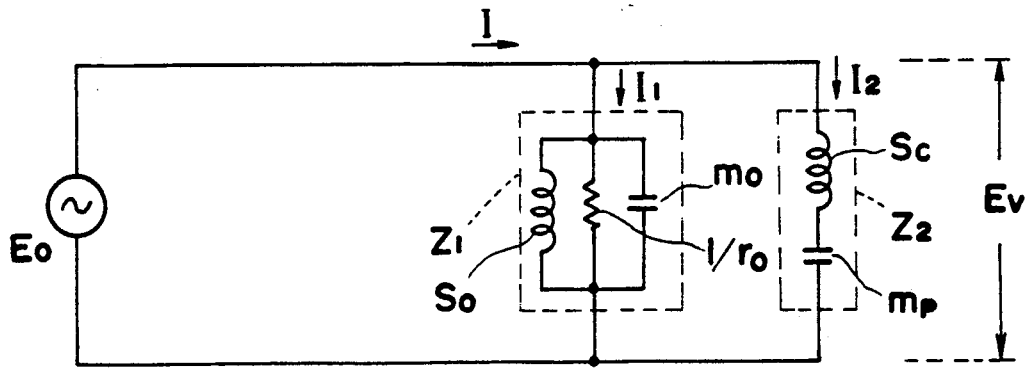
FIG. 24 is an electric equivalent circuit diagram of the apparatus shown in FIG. 22A.

FIG. 24 shows the electric equivalent circuit of FIG. 22B in a simplified form. In other words, FIG. 24 is an equivalent circuit diagram wherein the equivalent resistances $r_c$ of the cavity 14 of the resonator 10 as well as the equivalent resistance $r_p$ of the duct 16 is disregarded since said equivalent resistances are sufficiently small and the reciprocals thereof are extremely large and wherein the internal impedance $Z_v$ is practically invalidated ($Z_v=0$) by the motional feedback unit.

The electric equivalent circuit of FIG. 24 is quite identical with that (shown in FIG. 4) of the acoustic apparatus of said first embodiment and, therefore, quite the same explanation may apply to the latter. For example, a parallel resonance circuit $Z_1$ consisting of the equivalent motional impedance of the vibrator 20 and a series resonance circuit $Z_2$ consisting of the equivalent motional impedance of the Helmholtz resonator 10 are respectively short-circuited with zero impedance in an AC (alternate current) manner. As a result, the parallel resonance circuit $Z_1$ and the series resonance circuit $Z_2$ become to be present as resonance systems independently of each other. Therefore, if the Helmholtz resonator 10 is designed to be compact in order to reduce the size of the system, or when the duct 16 is designed to be elongated in order to reduce the Q value of the port resonance system, the design of the unit vibration system is not influenced at all, and the value corresponding to the lowest resonance frequency $f_o$ is not influenced at all, either. For this reason, easy designing of a vibrator and a resonator free from the mutual dependency condition is allowed.

Further, the parallel resonance circuit $Z_1$ comes under a condition of $Q=0$ and does not substantially resonate, while the series resonance circuit $Z_2$ comes under a condition of $Q\approx\infty$ and exhibits an extremely high capability of resonance and radiation. In addition, since the two circuits come under a condition of $Z_1>>Z_2$ in the neighborhood of resonance frequency $f_{op}$, the Helmholtz resonator 10 is driven by a large current and a small-amplitude voltage. Therefore, the transducer 22 connected in parallel therewith is also driven by the small-amplitude voltage, and hence, the diaphragm 21 performs a small-amplitude operation. In this case, since the diaphragm 21 performs the small-amplitude operation, a nonlinear distortion which usually occurs in a large-amplitude operation of a dynamic cone speaker can be effectively eliminated in, particularly, a super-bass range.

Figure 34:
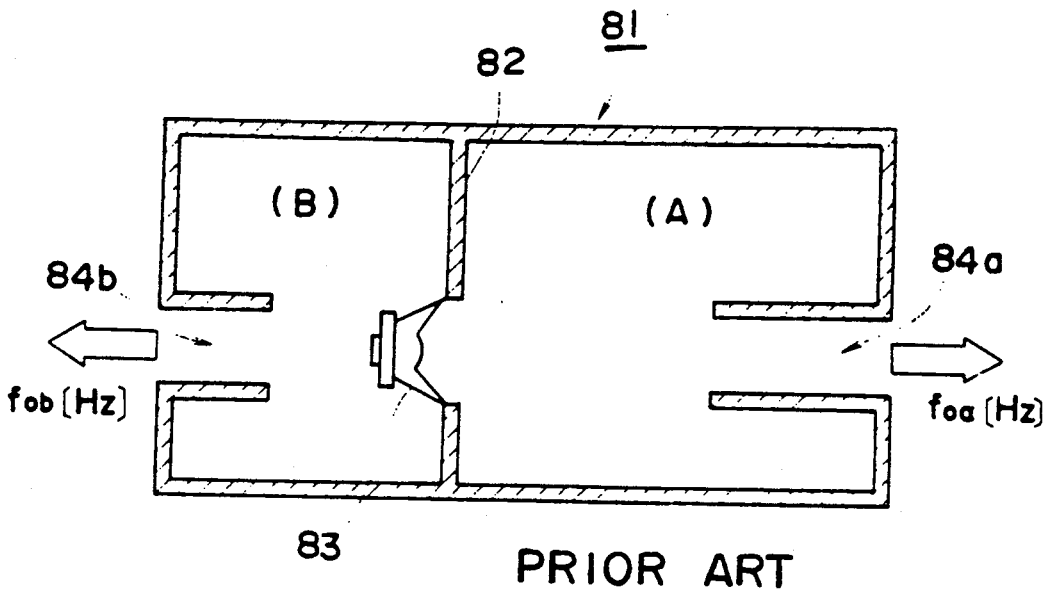
FIG. 34 is a sectional view of an acoustic apparatus of a first prior art using a resonator.
Figure 35:
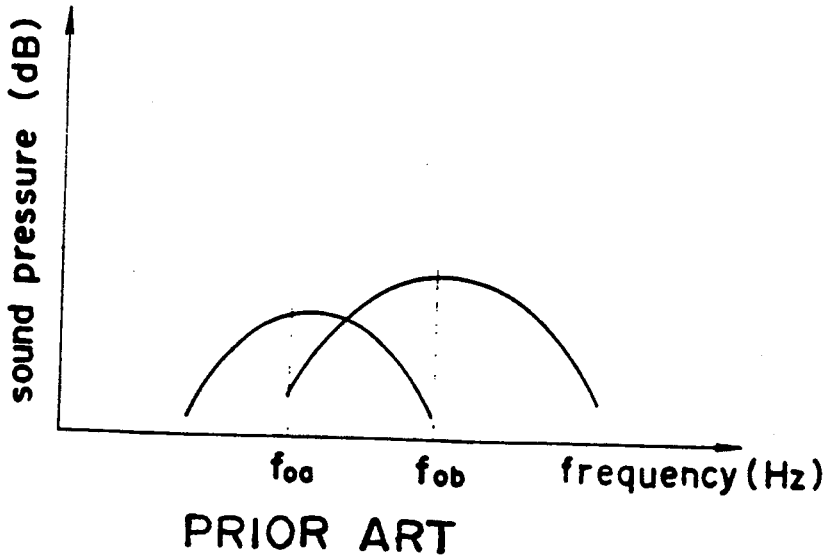
FIG. 35 is a graph for explaining sound pressure-frequency characteristics of the first prior art shown in FIG. 34.
Figure 36:
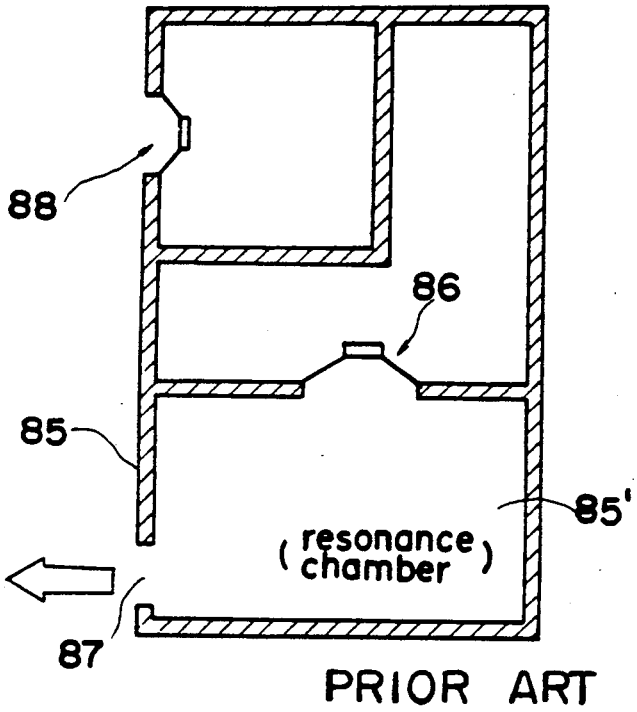
FIG. 36 is a sectional view showing an acoustic apparatus of a second prior art using a resonator.
Figure 37:
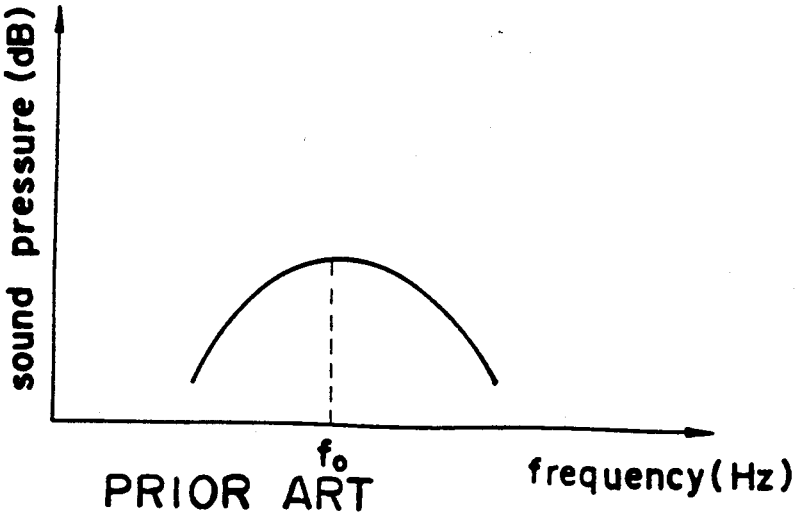
FIG. 37 is a graph for explaining sound pressure-frequency characteristics of the second prior art shown in FIG. 36.

It is easy to controllably lower too great Q, that is the excessively high resonance and radiation capability. Such a control is achieved even by, for example, elongating the opening port 11 and diminishing the cabinet in size, namely by miniaturizing the apparatus. This should be noted in contrast with the fact that if a conventional apparatus (cabinet) as shown in FIG. 34 or FIG. 36 is miniaturized, Q value, as a resonance system, will become extremely small and finally lose its acoustic radiation capability.

As mentioned above, according to the second embodiment, the resonance Q value of the resonator is extremely large (if approximate to an ideal state, Q approximates infinity). Although this resonator is driven by the displacement of the diaphragm in practice, the resonator can be assumed to receive a drive energy from a drive source in parallel with and independently of the vibrator in view of the equivalent circuit. Therefore, designing of the resonator can be made regardless of mutual dependency conditions between the resonator and the vibrator. In addition, since the volume of the cavity of the resonator does not influence the vibrator at all, the resonance frequency of the resonator is independently set without considering its volume, so that super-bass reproduction having a sufficient sound pressure can be achieved by a compact apparatus. For example, the sound pressure-frequency characteristics shown in FIG. 23 can be readily realized by a compact apparatus (cabinet).

In addition, even in a case where the internal impedance $Z_v$ is not completely invalidated ($Z_v=0$) but suitably reduced, there will be obtained effects corresponding to the degree of the reduction, this being the same as in the first embodiment.

Further, the shape of the cavity portion may be, for example, spheric, rectangular in section or cubic. The vibrators which may be used, include those of various kinds as indicated in FIGS. 5 to 12. Motional feedback and motional signal detection may also be effected by the use of the system indicated in FIGS. 13–19.

Concrete examples of the second embodiment will be explained below.

Figure 25:
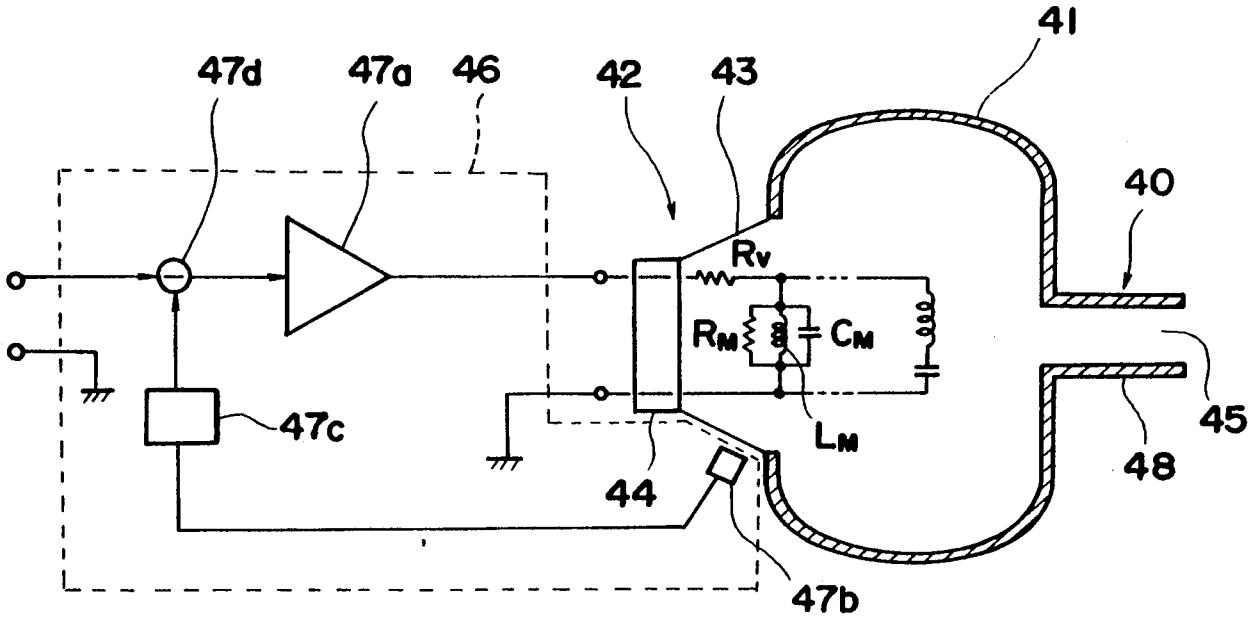
FIG. 25 is a diagram showing a concrete example of the second embodiment.

FIG. 25 is a diagram of a concrete example wherein this invention applied to a rectangle-prismatic shape cabinet. As shown in the Figure, a hole is formed in the rear surface (left surface in the Figure) of a rectangle-prismatic shape cabinet 41 as a cavity of the Helmholtz resonator, and a dynamic speaker 42 is mounted therein. The speaker 42 is constituted by a conical diaphragm 43, and a dynamic transducer 44 arranged near the top of the conical diaphragm 43. An opening port 45 is formed in a projecting neck 48 on the front surface side (right surface in the Figure) of the cabinet 41, and the cabinet 41, the opening port 45, etc. form a resonator as an acoustic radiation member of the present invention. A driver circuit 46 has a driver unit **47*a* having a large-open-loop gain, a detecting unit 47*b* for detecting the motional voltage applied to the equivalent motional impedance of the dynamic transducer 44, a feedback unit 47*c* for effecting a predetermined conversion on the output of the detecting unit 47*b*, and a subtracter 47*d* for negatively feeding back the motional signal outputted from the feedback unit 47*c* to the input side of the driver circuit 46. The dynamic transducer 44 is driven by the output of the driver circuit 46**.

The dynamic transducer 44 has a voice coil DC resistance $R_v$ as an inherent internal impedance, which can be apparently invalidated by the feedback driving of the driver circuit 46. Reference symbols $R_M$, $L_M$ and $C_M$ denote motional impedances obtained when the speaker 42 are electrically equivalently expressed. If the volume of the cabinet 41 is represented by V, the sectional area of the opening port 45 is represented by S, and the neck length of the duct 40 is represented by l, as in equation (1) described above, a resonance frequency $f_{op}$ is given by:

$$f_{op}=c(S/lV)^{1/2}/2\pi$$

Figure 26:
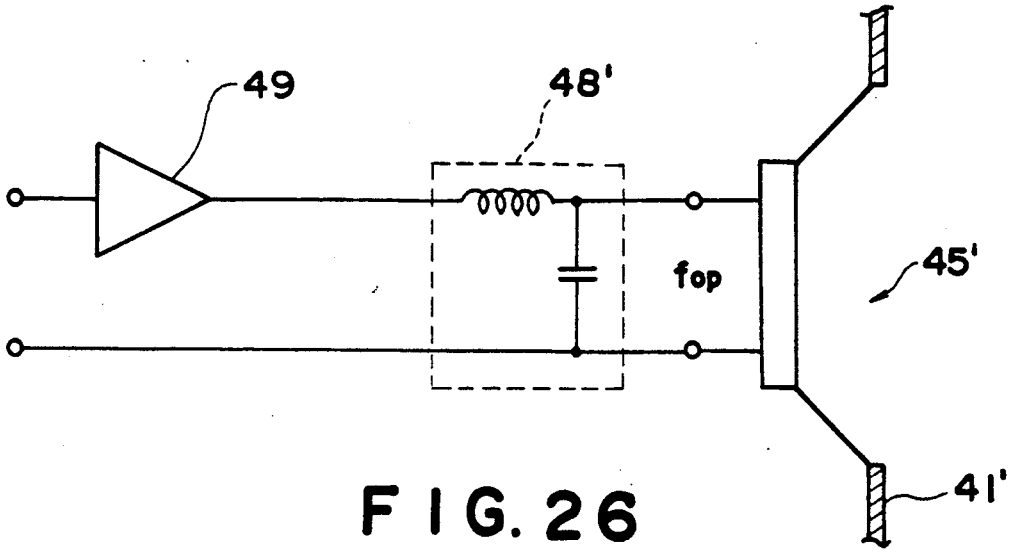
FIG. 26 is a diagram for explaining an equivalent operation of the apparatus shown in FIG. 25.
Figure 27:
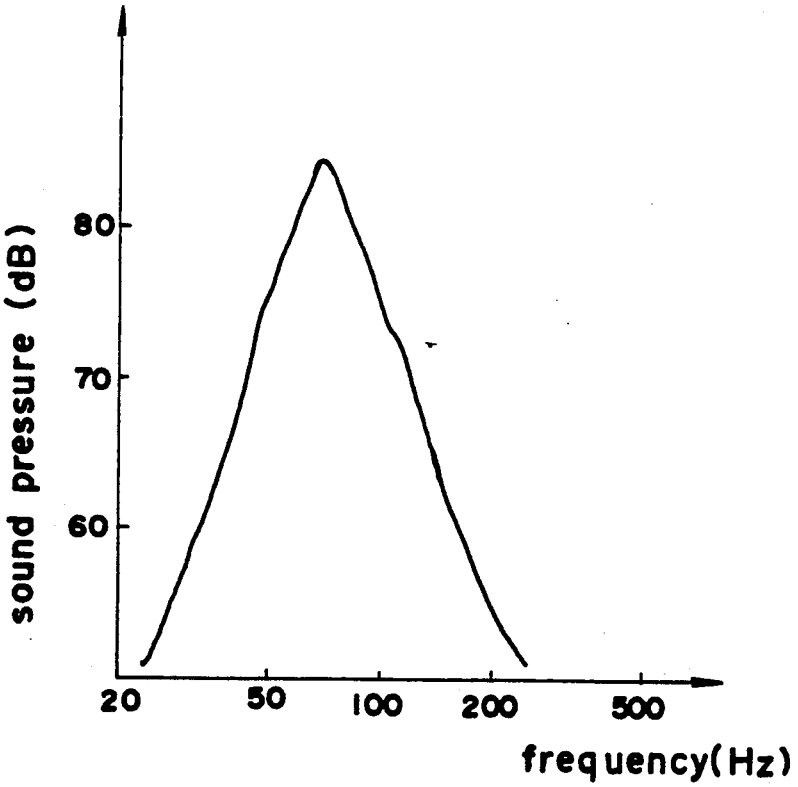
FIG. 27 is a graph showing sound pressure-frequency characteristics the apparatus shown in FIG. 25.

The arrangement of the equivalent operation of the example shown in FIG. 25 is as shown in FIG. 26. More specifically, a virtual speaker 45' equivalently formed by the opening port 45 is equivalent to a state wherein it is mounted on a closed cabinet 41' having an infinite volume. The speaker 45' is connected to a conventional amplifier 49 (which is not subjected to active servo drive) through an equivalently formed low-pass filter (LPF) 48'. (Note that the filter 48' is expressed as secondary LPF for the sake of emphasizing a similarity to a conventional network circuit.) The resonance frequency $f_{op}$ of the virtual speaker 45' is determined by only the opening port 45 and the duct 40, and a resonance Q value can be desirably controlled at a time.

As can be apparent from the above description, according to the concrete example shown in FIGS. 25 and 26, the virtual speaker is equivalently formed by the opening port 45 and the duct 40. Since this arrangement is equivalent to a state wherein the speaker is mounted on a closed cabinet having an infinite volume, extremely excellent bass reproduction characteristics can be realized. The specifications of the speaker unit and the cabinet can be desirably designed without restricting each other, and the cabinet can be rendered compact without posing a problem. The resonance frequency of the resonator formed by the cabinet can be set depending on the element other than the volume of the cabinet, and the system can be rendered compact as compared with any conventional speaker systems. Concretely, when the volume of the Helmholtz resonance cabinet was set to be 3.5 liters, excellent sound pressure-frequency characteristics illustrated in FIG. 27 could be obtained.

Note that sound pressure-frequency characteristics can be arbitrarily set by increasing/decreasing an input signal level according to the signal frequency by the amplifier. Since the acoustic radiation power of the resonator is sufficient, only by adjusting the input signal level as described above it can be easily realized to control reproduction power in an arbitrary sound pressure frequency band. In the circuit shown in FIG. 1 7, such adjusting is realized e.g. by the BPF circuit 220.

Figure 28:
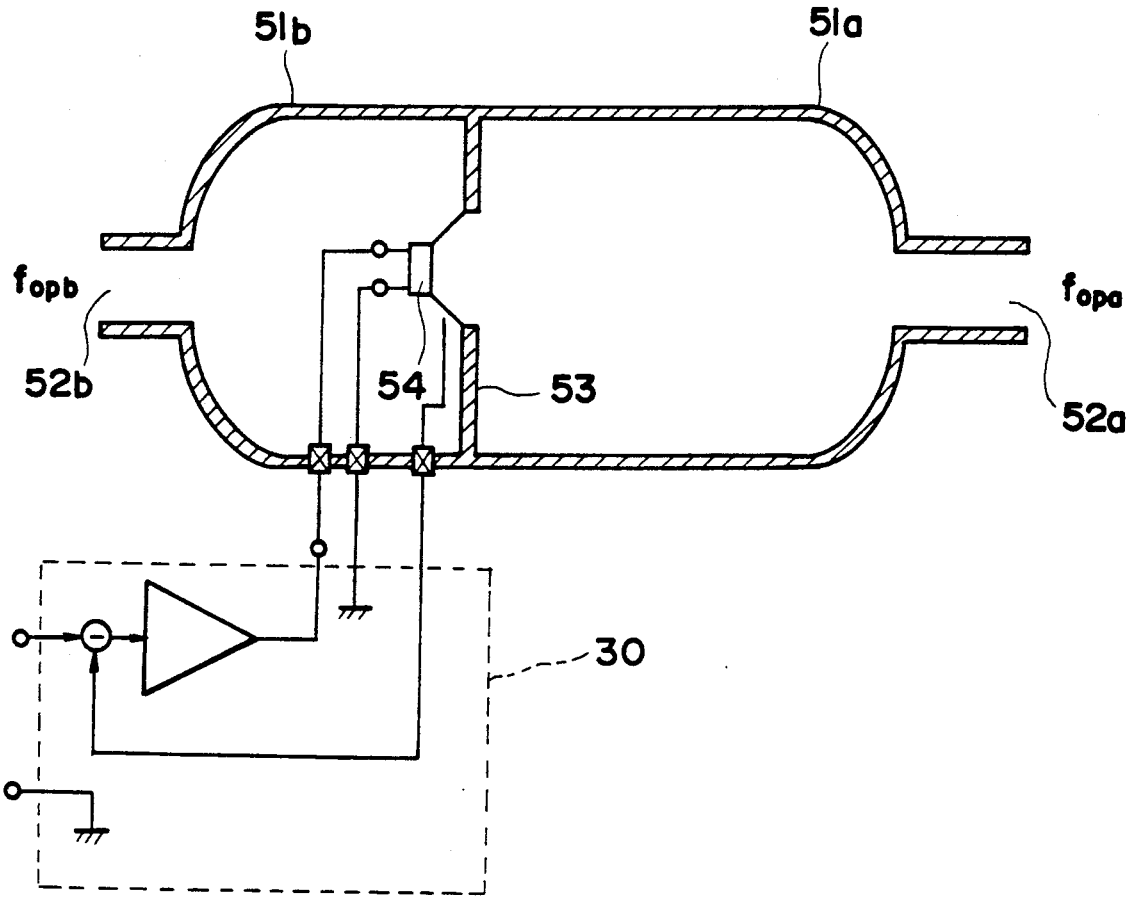
FIG. 28 is a diagram showing a modified example of the second embodiment.
Figure 29A:
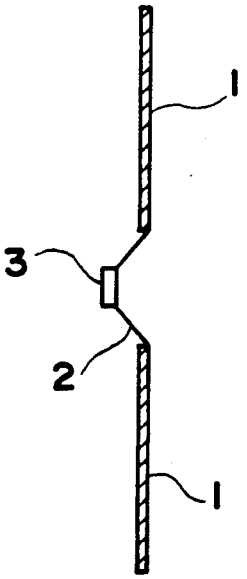
PRIOR ART FIG. 29A
FIGS. 29A to 29C are each a sectional view of a baffle used in a conventional speaker system.
Figure 29B:
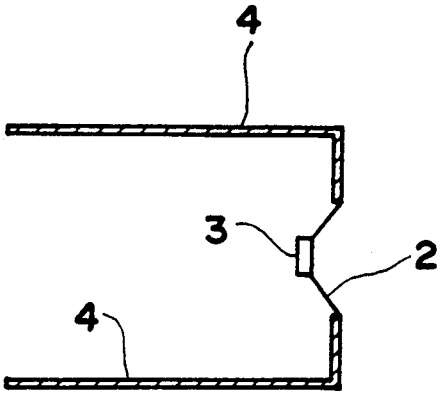
PRIOR ART FIG. 29B
Figure 29C:
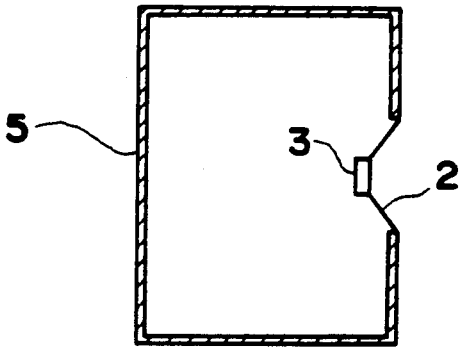
PRIOR ART FIG. 29C
Figure 30:
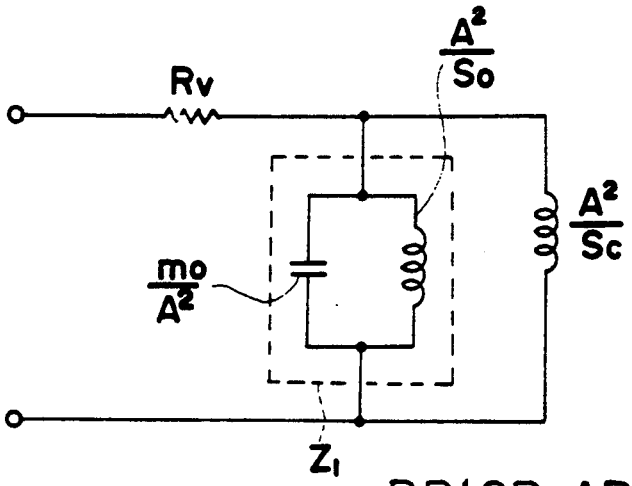
PRIOR ART FIG. 30
FIG. 30 is an electric equivalent circuit diagram of a closed speaker system.
Figure 31A:
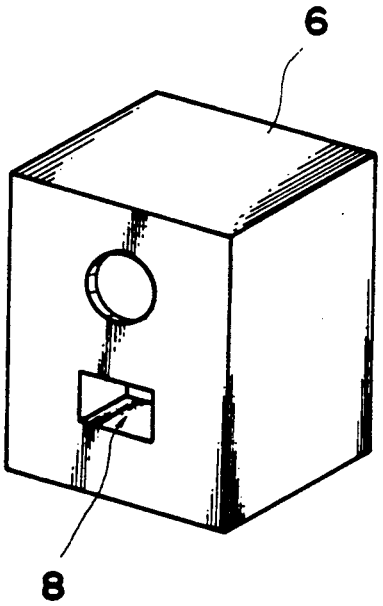
PRIOR ART FIG. 31A
FIGS. 31A and 31B are views together showing a bass-reflex type speaker system.
Figure 31B:
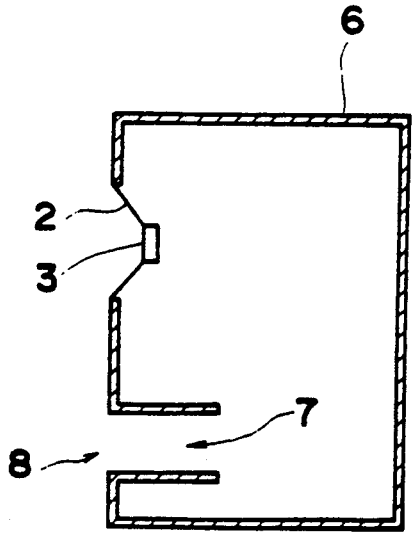
PRIOR ART FIG. 31B
Figure 32:
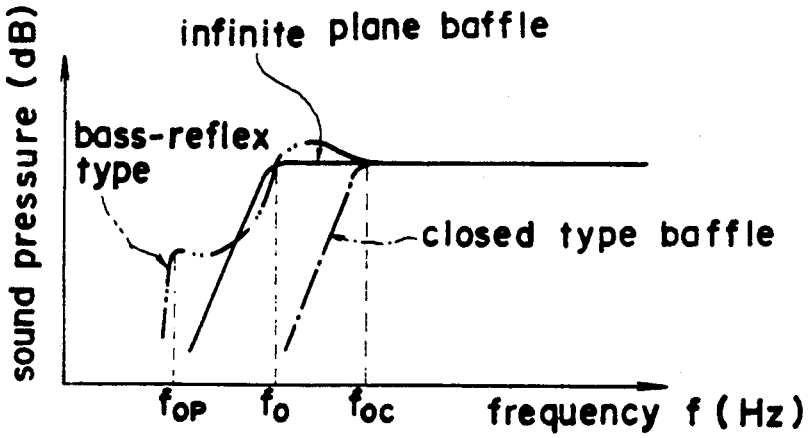
PRIOR ART FIG. 32
FIG. 32 is a graph for comparing sound pressure-frequency characteristics of the prior arts.
Figure 33:
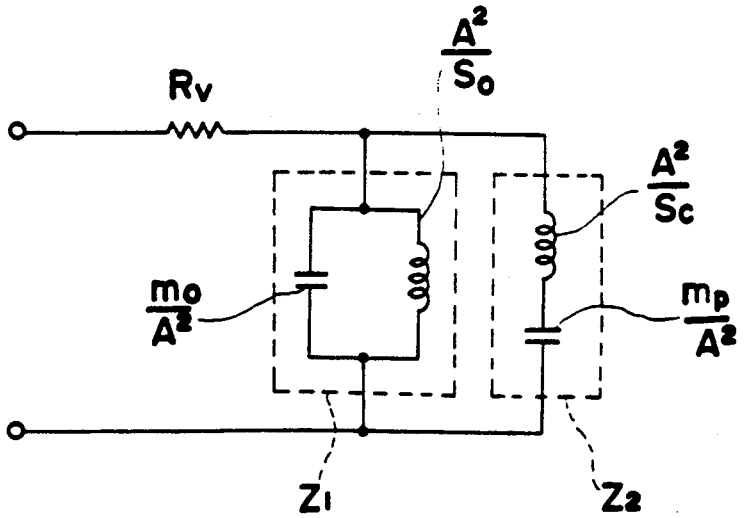
PRIOR ART FIG. 33
FIG. 33 is an electric equivalent circuit diagram of a bass-reflex speaker system.

FIG. 28 shows another concrete example of the second embodiment. As shown in the Figure, a Helmholtz resonator comprises first and second resonators **51*a* and 51*b*, which have opening ports 52*a* and 52*b*, respectively. A hole is formed in a partition wall 53 between the resonators 51*a* and 52*b*, and a dynamic speaker 54 is mounted therein. The speaker 54 is driven by a drive controller 30 having a motional feedback function without being influenced by reactions from the first and second resonators 51***a* and 51*b*, and its diaphragm becomes part of wall surfaces of these resonators. In this case, Helmholtz resonance systems A and B have independent resonance frequencies $f_{opa}$ and $f_{opb}$, respectively.

The present inventor obtained the following results upon comparison between the effect of the acoustic apparatus according to present invention and the effect of the conventional apparatus.

In an acoustic apparatus according to the present invention, the volume of the cavity of the Helmholtz resonator was 6 liters, the inner diameter of the opening port was 3.3 cm, and its neck length was 25 cm. When a motional feedback drive operation was performed with a dynamic cone speaker, super-bass reproduction to $f_{op}=41$ Hz could be achieved. In contrast to this, in a conventional apparatus which does not perform such a motional feedback drive, super-bass reproduction to $f_{op}=41$ Hz was barely achieved when a dynamic cone speaker having $f_o=50$ Hz, $Q=0.5$ and a diameter $=20$ cm, and a cabinet having a volume of 176 liters are used. Therefore, it was found that the volume of the cabinet could be reduced to about 1/30 at an identical bass reproduction level according to the present invention.

EFFECT OF THE SECOND ASPECT OF THIS INVENTION

As has been described above in detail, according to the present invention, due to operation of a motional feedback means included in a vibrator drive means, the drive condition of the vibrator drive means is brought under follow-up control so that a signal in an amount corresponding to drive input is always correctly transmitted to an equivalent motional impedance side of a vibrator, whereby an internal impedance inherent in the vibrator can be apparently reduced or invalidated. For this reason, the vibrator becomes an element responsive to only an electrical drive signal input, and since the resonance system of the vibrator will not function as such, the diaphragm of the vibrator becomes equivalent only to the wall surface of a resonator, whereby the internal impedance of the vibrator will not cause a decrease in resonance Q value. For this reason, the resonance Q value may be extremely increased. The resonator and the vibrator are independent of each other, and the resonance frequency of the resonator can also be set depending on the elements (such as the cross-section and length of the duct) other than the volume of the resonator. Therefore, such a resonator can be readily made in compact form. When the compact resonator so made and a lowered resonance frequency are used, even in a case where the acoustic resistance of the resonator is increased and the resonance Q value is much decreased in a conventional drive system, the resonance Q value is not decreased by the vibrator. As a result, the resonance Q value can be maintained at a sufficiently high value, and sufficient acoustic radiation of the resonator can be kept.

In addition, since the apparent reduction or invalidation, above described, of the internal impedance inherent in the vibrator is basically realized by negative feedback, so-called excessive cancellation cannot be caused, and oscillation and the like are unlikely to be caused.

As described above, improvement of radiation power of a resonance acoustic wave and miniturization of a resonator can be simultaneously achieved. The acoustic apparatus of the present invention can be widely applied to sound sources of electronic or electric musical instruments, and the like as well as audio speaker systems.

What is claimed is:

1. An acoustic apparatus comprising:

a body portion having an internal cavity therein defining a resonator and having a port therein forming a resonance radiation unit for radiating an acoustic wave by resonance;

a vibrator disposed in the body portion and having a diaphragm, including a direct radiation portion for directly radiating an acoustic wave outwards from the resonator and a resonator driver portion for driving said resonator, the driving of the resonator tending to produce counteracting air movement from the cavity of the body portion upon the diaphragm; and a vibrator drive means having a motional feedback means responsive to movement of said diaphragm for producing a motional signal corresponding to movement of said diaphragm and negatively feeding back the motional signal to the vibrator drive means, said vibrator drive means responding to the negatively fed back motional signal from the motional feedback means to effect motional feedback driving of said vibrator in a manner which substantially cancels counteracting air movement from the cavity of the body portion upon the diaphragm.

2. An apparatus according to claim 1, wherein:

said body portion comprises a cabinet having a first opening in which said vibrator is disposed and a second opening serving as said resonance radiation unit, and said diaphragm of said vibrator constitutes said direct radiator portion on a portion thereof facing an outer region of said cabinet, and constitutes said resonator driver portion on an opposite portion thereof facing an inner surface of said cabinet.

3. An apparatus according to claim 1, wherein said motional feedback means comprises a motional signal detecting means for detecting a motional signal corresponding to at least one of vibration deviation, velocity and acceleration of said diaphragm of the vibrator, and a feedback means for negatively feeding back said motional signal to the vibrator drive means.

4. An apparatus according to claim 1, wherein said motional feedback means detects said motional signal in an electrical circuit manner from said vibrator drive means.

5. An apparatus according to claim 1, wherein said motional feedback means detects said motional signal from motion of said diaphragm of the vibrator.

6. An acoustic apparatus comprising:

a body portion having an internal cavity therein defining a resonator and having a port therein forming a resonance radiation unit for radiating an acoustic wave by resonance;

a vibrator disposed in the body portion and having a diaphragm constituting a part of said resonator and disposed in communication with the cavity in the body portion, the resonator tending to produce counteracting air movement from the cavity therein upon the diaphragm; and a vibrator drive means having a motional feedback means responsive to movement of said diaphragm for producing a motional signal corresponding to movement of said diaphragm and negatively feeding back the motional signal to the vibrator drive means, said vibrator drive means responding to the negatively fed back motional signal from the motional feedback means to effect motional feedback driving of said vibrator in a manner which substantially cancels counteracting air movement from the cavity of the body portion upon the diaphragm.

7. An apparatus according to claim 6, wherein said motional feedback means comprises a motional signal detecting means for detecting a motional signal corresponding to at least one of vibration deviation, velocity and acceleration of said diaphragm of the vibrator, and a feedback means for negatively feeding back said motional signal to the vibrator drive means.

8. An apparatus according to claim 6, wherein said motional feedback means detects said motional signal in an electrical circuit manner from said vibrator drive means.

9. An apparatus according to claim 6, wherein said motional feedback means detects said motional signal from motion of said diaphragm of the vibrator.

* * * * *